US009894442B2

(12) United States Patent
Salvatti

(10) Patent No.: US 9,894,442 B2
(45) Date of Patent: Feb. 13, 2018

(54) HALBACH ARRAY AUDIO TRANSDUCER

(71) Applicant: Apple Inc., Cupertino, CA (US)

(72) Inventor: Alexander V. Salvatti, Morgan Hill, CA (US)

(73) Assignee: APPLE INC., Cupertino, CA (US)

( * ) Notice: Subject to any disclaimer, the term of this patent is extended or adjusted under 35 U.S.C. 154(b) by 76 days.

(21) Appl. No.: 14/844,883

(22) Filed: Sep. 3, 2015

(65) Prior Publication Data

US 2016/0212546 A1 Jul. 21, 2016

Related U.S. Application Data

(60) Provisional application No. 62/104,524, filed on Jan. 16, 2015.

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2209/024* (2013.01); *H04R 2499/11* (2013.01)

(58) Field of Classification Search
CPC . H04R 9/00; H04R 9/06; H04R 9/025; H04R 9/047; H04R 2499/11
See application file for complete search history.

(56) References Cited

U.S. PATENT DOCUMENTS 4,081,627 A 3/1978 Crist
7,450,729 B2 11/2008 Nguyen et al.
7,929,726 B1 4/2011 Jones
9,287,029 B1 * 3/2016 Colich ..... H01F 7/0289
2006/0188120 A1 * 8/2006 Fisher ..... H04R 9/025 381/338
2009/0016563 A1 1/2009 Wei et al.
2015/0003662 A1 1/2015 Vernon et al.
2015/0264486 A1 * 9/2015 Yuan ..... H04R 7/04 381/431
2016/0212545 A1 * 7/2016 Morgan ..... H04R 9/025

FOREIGN PATENT DOCUMENTS

AU 2014201937 A1 10/2014

OTHER PUBLICATIONS

"Audeze Planars", Audeze, https://www.audeze.com/technology/tech-tour/audeze-planars, Dec. 10, 2014, 1 pg.
Tyll Hertsens, "How Planar Magnetic Headphones Work", May 11, 2001, 6 pages.
PCT International Search Report and Written Opinion for PCT International Appln No. PCT/US2015/067212 dated Mar. 14, 2016. (16 pages).
International Preliminary Report on Patentability, Appln No. PCT/US2015/067212 dated Jul. 27, 2017. (12 pages).

* cited by examiner

*Primary Examiner* — Matthew Eason
(74) *Attorney, Agent, or Firm* — Womble Bond Dickinson (US) LLP

(57) ABSTRACT

An audio speaker having a voicecoil running along a diaphragm surface, and a magnetic array, e.g., a Halbach array, configured to direct a magnetic field toward the voicecoil to drive the diaphragm and generate sound. In an embodiment, multiple Halbach arrays are used to drive the same voicecoil winding or to drive separate, respective voicecoil windings on the diaphragm surface. Other embodiments are also described and claimed.

23 Claims, 19 Drawing Sheets

A - A

HALBACH ARRAY AUDIO TRANSDUCER

This application claims the benefit of U.S. Provisional Patent Application Ser. No. 62/104,524 filed on Jan. 16, 2015, the full disclosure of which is incorporated herein by reference.

BACKGROUND

Field

Embodiments related to an audio speaker having a voicecoil running along a dielectric surface of a diaphragm, and a magnetic array configured to direct a magnetic field toward the voicecoil to drive the diaphragm and generate sound, are disclosed. More particularly, an embodiment related to a voicecoil having a conductive winding running along a path on the dielectric surface, centered over and following a middle magnetized portion of a Halbach array, is disclosed.

Background Information

An audio speaker driver converts an electrical audio input signal into an emitted sound. FIG. 1 shows a sectional view of a typical audio speaker. An audio speaker 100 may include a housing 102 surrounding a diaphragm 104 and a motor assembly 108. More particularly, diaphragm may be a thin-walled cone or dome that is connected to housing by a speaker surround that allows diaphragm to move axially with pistonic motion, i.e., forward and backward. Furthermore, diaphragm may be connected with a motor assembly via a voice coil former 112, e.g., a cylinder extending axially rearward from diaphragm. The motor assembly generally includes a voicecoil 110 wound in a helix around the neck portion in an axial direction away from the diaphragm, a magnet 114, and a magnetic return structure to sandwich the magnet between a top plate 116 and a yoke 118. In particular, the magnet may be a permanent magnet that produces a magnetic field, and the top plate and yoke may be shaped to direct the magnetic field across a gap between top plate and yoke. Voicecoil is typically located within the gap behind the diaphragm such that the magnetic field is directed perpendicular to the cylindrical surface of the voicecoil. When the voicecoil is energized by an electrical audio input signal, a mechanical force is generated to cause voicecoil to move diaphragm back and forth to generate sound.

SUMMARY

Portable consumer electronics devices, such as mobile phones, have continued to become more and more compact. As the form factor of such devices shrinks, system enclosures become smaller and the space available for speaker integration is reduced. In the case of an audio speaker having a voicecoil suspended below a diaphragm within a gap of a magnetic return structure, as described above, precious space is occupied by the magnetic return structure that is required to direct the magnetic field produced by the magnet around the voicecoil. More particularly, since the voicecoil and the magnetic return structure extend along the axis of sound emission, they take up z-height (the vertical direction in FIG. 1) and limit the degree to which the speaker thickness can be reduced. As described below, eliminating the magnetic return structure and helical voicecoil may allow for the vertical thickness of the speaker to be reduced. That is, the voicecoil may be integrated along a surface of the diaphragm and configured to interact with a magnetic field produced by a magnetic array such that the voicecoil operates within the fringe flux of the magnetic field and the thickness of the speaker is limited only by the magnetic array thickness and the excursion clearance of the diaphragm.

In an embodiment, an electromagnetic transducer for sound generation includes a diaphragm configured to move along a central axis. The diaphragm may include a dielectric surface orthogonal to the central axis, and a voicecoil may be coupled with the dielectric surface. The voicecoil may have a conductive winding on the diaphragm, e.g., with one or more conductive paths running along the dielectric surface. Furthermore, the electromagnetic transducer may include a magnetic Halbach array having at least three magnetized portions arranged side-by-side. Each magnetized portion may extend along a respective longitudinal axis and produce respective magnetic field lines perpendicular to the respective longitudinal axis. Thus, the magnetic Halbach array may direct the magnetic field lines toward the voicecoil such that the magnetic field lines intersect the voicecoil to cause a Lorentz force to move the diaphragm along the central axis. The magnetic field lines that intersect the voicecoil may run parallel to the dielectric surface and perpendicular to the conductive winding.

Various magnetic Halbach array configurations may be incorporated in the electromagnetic transducer. For example, the magnetic Halbach array may include five or more magnetized portions arranged side-by-side such that each magnetized portion that is sandwiched between two adjacent magnetic portions produces respective magnetic field lines perpendicular to respective magnetic field lines produced by the adjacent magnetic portions. The magnetized portions may include magnetic rods, and a middle magnetized portion of the magnetized portions may include a rod length and a rod width. In an embodiment, the conductive winding includes a winding length that runs parallel to the rod length of the middle magnetized portion, and a winding width is between 0.5 to 2.0 times the rod width.

In an embodiment, the conductive winding may follow a spiral path along the dielectric surface. For example, the spiral path may be essentially rectangular, having longitudinal and transverse segments interconnected at angular or curved corners of the winding. Thus, the winding length may be at least 2 times longer than the winding width. Furthermore, the conductive paths of the winding may run along the dielectric surface around the central axis, and the conductive winding may include a winding thickness in a direction of the central axis, e.g., the winding thickness may be less than 0.5 mm and/or the winding thickness may be at least 20 times less than the winding width. The conductive paths may be coplanar within a winding plane that is perpendicular to the central axis. Furthermore, the one or more conductive paths may surround a core area that is centered over the middle magnetic portion.

The electromagnetic transducer may include one or more additional conductive windings coupled with the dielectric surface and one or more additional magnetic Halbach arrays having respective middle magnetized portions. Each additional conductive winding may include one or more conductive paths running along the dielectric surface and around a respective core area centered over a respective middle magnetized portion of a respective magnetic Halbach array. The conductive winding and the one or more additional conductive windings may be electrically connected in series such that the conductive winding and the one or more additional conductive windings simultaneously move the diaphragm in response to an electrical audio signal applied to the conductive winding. Alternatively, the conductive winding and the one or more additional conductive windings may not be electrically connected such that the conductive winding moves the diaphragm in response to a first electrical audio signal applied to the conductive winding, and the one or more additional conductive windings move the diaphragm in response to a second electrical audio signal applied to the one or more additional conductive windings.

In an embodiment, an electromagnetic transducer for sound generation includes a diaphragm configured to move along a central axis. The diaphragm may have a dielectric surface orthogonal to the central axis, and a voicecoil stack having a plurality of conductive windings may be coupled with the dielectric surface. Each conductive winding may be within a respective coil layer, and the respective coil layers may be separated along the central axis by one or more intermediate insulating layers. For example, the voicecoil stack may include a multiple of two coil layers with insulating layers between the coil layers. Furthermore, the conductive windings may be electrically connected in series. The electromagnetic transducer may include a magnetic Halbach array having at least three magnetized portions arranged side-by-side, and each magnetized portion may extend along a respective longitudinal axis and produce respective magnetic field lines perpendicular to the respective longitudinal axis. Thus, the magnetic Halbach array may direct the magnetic field lines toward the voicecoil stack such that the magnetic field lines intersect the voicecoil to cause a Lorentz force to move the diaphragm along the central axis.

In an embodiment, an electromagnetic transducer for sound generation includes a diaphragm configured to move along a central axis. The diaphragm may have a dielectric surface orthogonal to the central axis, and a voicecoil may be coupled with the dielectric surface. The voicecoil may include a conductive winding having one or more conductive paths running along the dielectric surface. The electromagnetic transducer may also include a first magnetic Halbach array and a second magnetic Halbach array. The first magnetic Halbach array may be behind the diaphragm and include at least three magnetized portions arranged side-by-side. Each magnetized portion may extend along a respective longitudinal axis and produce respective magnetic field lines perpendicular to the respective longitudinal axis. Thus, the first magnetic Halbach array may direct the respective magnetic field lines toward a rear of the diaphragm such that the magnetic field lines intersect the voicecoil to cause a Lorentz force to move the diaphragm along the central axis. The second magnetic Halbach array may be in front of the diaphragm and include at least three magnetized portions arranged side-by-side. Each magnetized portion may extend along a respective longitudinal axis and produce respective magnetic field lines perpendicular to the respective longitudinal axis. Thus, the second magnetic Halbach array may direct the respective magnetic field lines toward a front of the diaphragm such that the magnetic field lines intersect the voicecoil to cause the Lorentz force to move the diaphragm along the central axis. In an embodiment, the second magnetic Halbach array includes a respective gap between each magnetized portion such that a sound emitted from the diaphragm in response to an electrical audio signal applied to the conductive winding travels forward through the gaps.

In an embodiment, a mobile phone handset is provided having a housing and a micro speaker coupled with the housing. The micro speaker may include a diaphragm configured to move along a central axis. The diaphragm may have a dielectric surface orthogonal to the central axis, and a voicecoil coupled with the dielectric surface. The voicecoil may include a conductive winding having one or more conductive paths running along the dielectric surface. The micro speaker may also include a magnetic Halbach array including at least three magnetized portions arranged side-by-side. Each magnetized portion may extend along a respective longitudinal axis and produce respective magnetic field lines perpendicular to the respective longitudinal axis. Thus, the magnetic Halbach array may direct the magnetic field lines toward the voicecoil such that the magnetic field lines intersect the voicecoil to cause a Lorentz force to move the diaphragm along the central axis. In an embodiment, the magnetic field lines that intersect the voicecoil run parallel to the dielectric surface and perpendicular to the conductive winding. The micro speaker may include a processor to provide an electrical audio signal to the conductive winding to move the diaphragm in response to the electrical audio signal.

Various magnetic Halbach array configurations may be incorporated in the mobile phone handset. For example, the magnetic Halbach array may include five or more magnetized portions arranged side-by-side such that each magnetized portion that is sandwiched between two adjacent magnetic portions produces respective magnetic field lines perpendicular to respective magnetic field lines produced by the adjacent magnetic portions. The magnetized portions may include magnetic rods, and a middle magnetized portion of the magnetized portions may include a rod length and a rod width.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
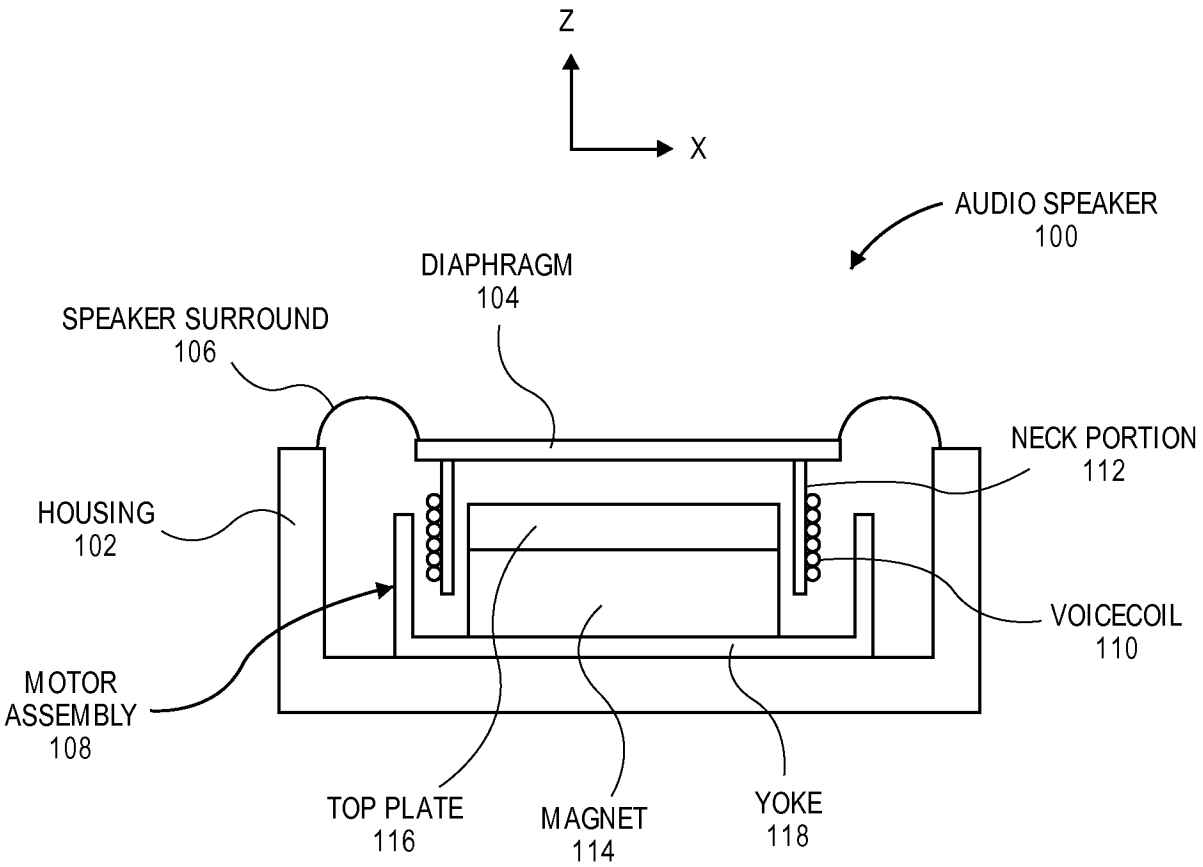
FIG. 1 is a sectional view of an audio speaker having a voicecoil extending away from a diaphragm.

Embodiments describe an audio speaker having a voicecoil running along a dielectric surface of a diaphragm, and a magnetic array configured to direct a magnetic field toward the voicecoil to drive the diaphragm and generate sound. However, while some embodiments are described with specific regard to integration within mobile electronics devices, such as handheld devices, the embodiments are not so limited and certain embodiments may also be applicable to other uses. For example, an audio speaker as described below may be incorporated into other devices and apparatuses, including desktop computers, laptop computers, or tablet computers, to name only a few possible applications. Similarly, although the following description commonly refers to the audio speaker as being a "microspeaker", this description is not intended to be limiting, and an audio speaker as described below may be scaled to be any size and emit any range of frequencies.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description may denote a relative position or direction. For example, "forward" or "in front of" may indicate a first axial direction away from a reference point. Similarly, "rearward" or "behind" may indicate a location in a second direction from the reference point opposite to the first axial direction. However, such terms are not intended to limit the use of an audio speaker to a specific configuration described in the various embodiments below. For example, a microspeaker may be oriented to radiate sound in any direction with respect to an external environment, including upward toward the sky and downward toward the ground.

In an aspect, an audio speaker includes a topology which has the benefit of shallow depth. In an embodiment, an audio speaker includes a spiral-wound printed or etched voicecoil integrated with a diaphragm that is located in front of a linear magnetic Halbach array. The audio speaker, e.g., a microspeaker, does not require a ferromagnetic return path, and thus, may have a reduced z-height compared to typical loudspeakers. In an embodiment, the diaphragm may be located between dual opposing Halbach arrays to increase output efficiency and provide magnetic shielding. The microspeaker can be front firing or side firing.

Figure 5A:
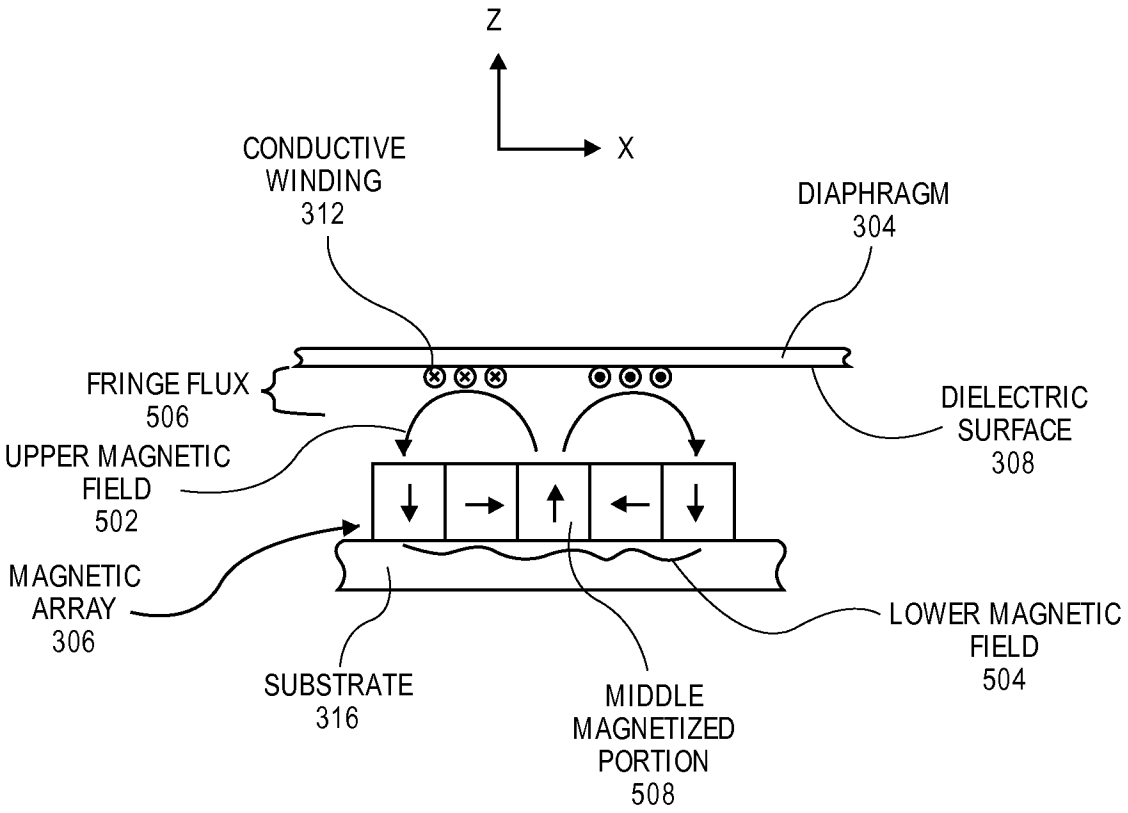
FIG. 5A is a sectional view of an audio speaker having a voicecoil running along a diaphragm surface within a fringe flux of a Halbach array in accordance with an embodiment.

In an aspect, an audio speaker includes a motor assembly that is scalable in both height and surface area using simple construction. The audio speaker may include substantially planar voicecoils formed across a surface area of a diaphragm using well-known printing and etching processes. The voicecoils may interact with fringe fluxes of one or more Halbach arrays, that can be easily constructed by arranging individual magnets, e.g., bar magnets, in a side-by-side fashion as shown in FIG. 5A, below. The basic magnet array group or "cell" is shown in some of the figures as being a five-magnet Halbach array with the central magnet polarized in a direction perpendicular to the coil plane, and the side magnets each rotated 90 degrees with respect to a neighboring magnet. However, a similar magnetic field shape can be obtained by using a three-magnet Halbach array (by eliminating the two magnets on the ends of the magnet array (e.g., magnetic array 306 shown below in FIG. 5). Also, it should be noted that the shape of the individual magnets in the array is shown to be square in cross section, but the concept may be extended to other sizes and shapes of magnets. For example, rectangular or triangular shaped individual magnets may be incorporated into a magnetic array. Furthermore these magnet cells may be arranged into composite structures, e.g., rectangles or circles, which can naturally fit the form factor of a variety of different coil or diaphragm shapes.

In an aspect, an audio speaker includes a moving diaphragm that has distributed surface driving points that help to extend a high frequency response. The audio speaker may include one or more voicecoils integrated in-plane with the diaphragm at separate locations, and the voicecoils may be paired with respective Halbach arrays to create a surface driven device in which force is applied over a substantially larger percentage of the entire surface area of the diaphragm, and thus, standing waves and break up modes are decreased while smoothness of frequency response and power handling is increased.

Figure 2:
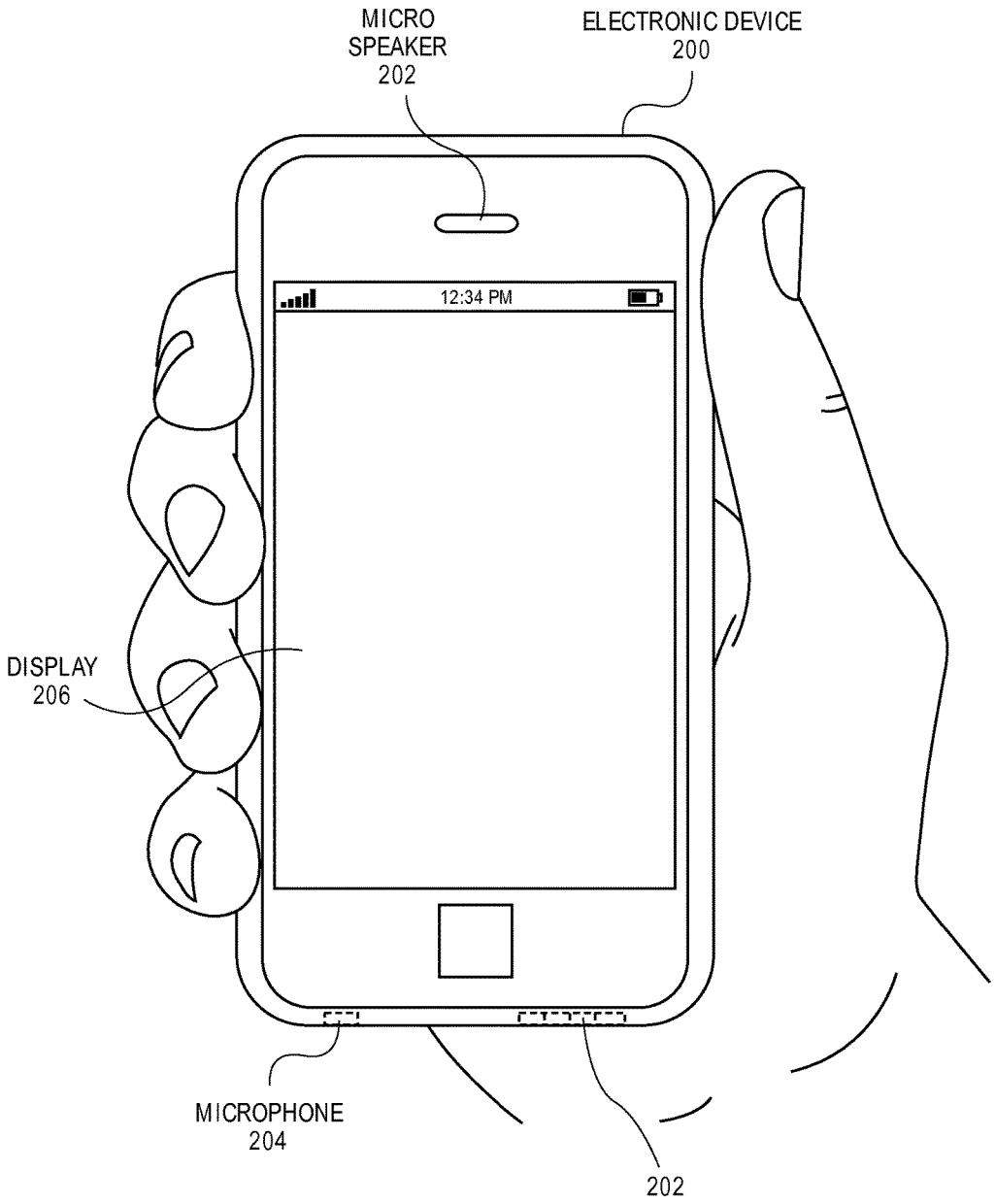
FIG. 2 is a pictorial view of an electronic device in accordance with an embodiment of the invention.

Referring to FIG. 2, a pictorial view of an electronic device is shown in accordance with an embodiment of the invention. An electronic device 200 may be a smartphone device. Alternatively, it could be any other portable or stationary device or apparatus incorporating an audio speaker, e.g., a microspeaker 202, such as a laptop computer or a tablet computer. Electronic device may include various capabilities to allow the user to access features involving, for example, calls, voicemail, music, e-mail, internet browsing, scheduling, and photos. Electronic device may also include hardware to facilitate such capabilities. For example, electronic device may include cellular network communications circuitry. An integrated microphone 204 may pick up the voice of its user during a call, and microspeaker may deliver a far-end voice to the near-end user during the call. Microspeaker may also emit sounds associated with music files played by a music player application running on electronic device. A display 206 may be integrated within a housing of electronic device to present the user with a graphical user interface to allow a user to interact with electronic device and applications running on electronic device. The housing may be sized to be gripped comfortably by the user. Other conventional features are not shown but may of course be included in electronic device.

Electronic device may have a thin profile, and thus, may have limited space, e.g., z-height, available for integration of microspeaker. For example, electronic device may have a z-height that is insufficient to fit an audio speaker having a helically wound voicecoil and magnetic return structure extending away from a diaphragm, as described above. Accordingly, electronic device may benefit from microspeaker having a topology with a shallow depth and a motor assembly that does not require a helically wound voicecoil or a magnetic return structure.

Figure 3:
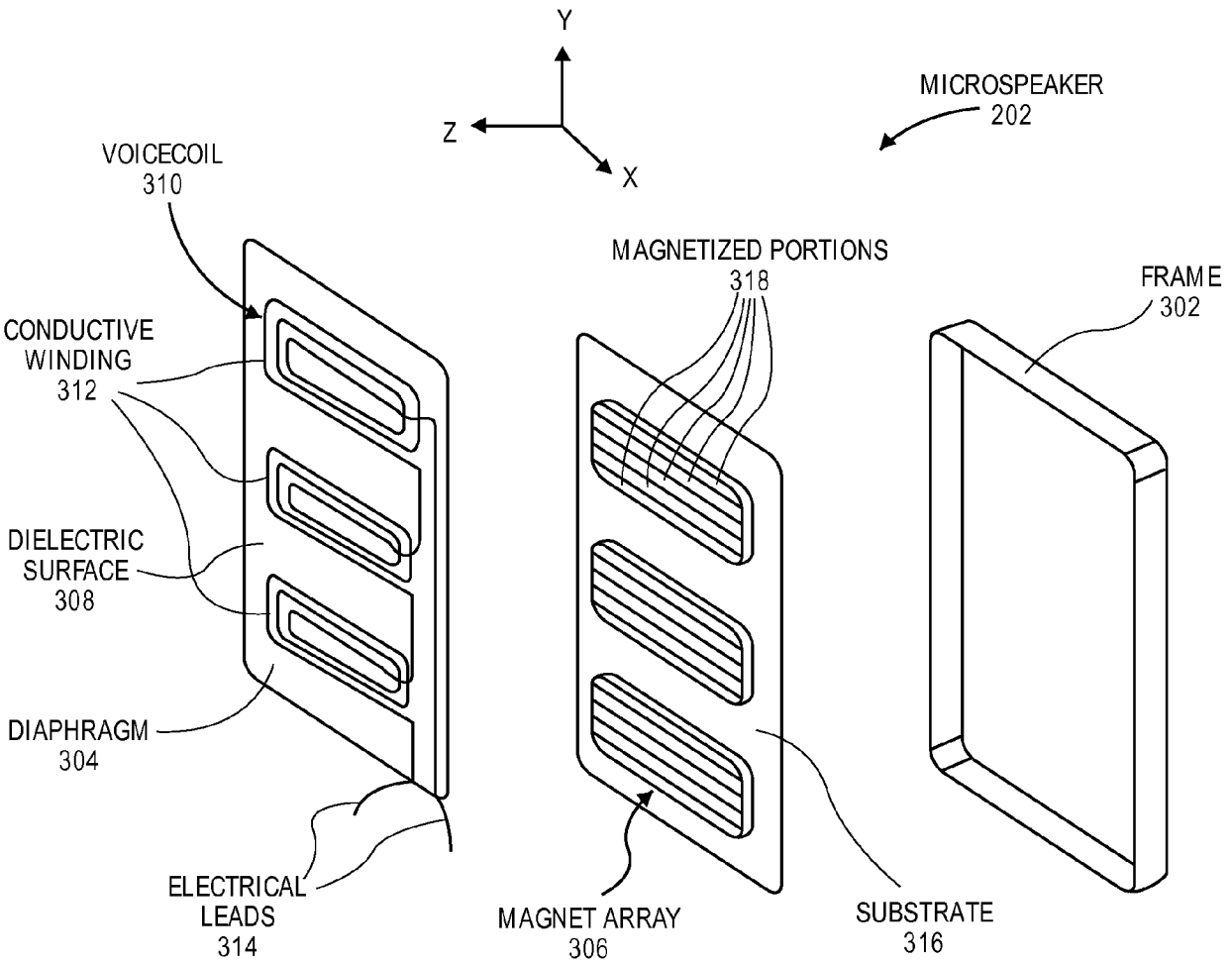
FIG. 3 is an exploded view of an audio speaker having several magnetic arrays paired with conductive windings at surface driving points on a diaphragm in accordance with an embodiment.

Referring to FIG. 3A, an exploded view of an audio speaker having several magnetic arrays paired with conductive windings at surface driving points on a diaphragm is shown in accordance with an embodiment. Microspeaker may be an assembly of several components that are separated here for illustration purposes. For example, microspeaker may include a frame 302 to surround or support a diaphragm 304 relative to one or more magnetic arrays 306. Frame may be a portion of a micro speaker housing. Diaphragm may have any outer shape, and thus, although a rectangular diaphragm is shown, diaphragm may be circular, polygonal, etc. Diaphragm may be constructed from known materials used in the construction of speaker diaphragms, including paper, thermoformed polymers such as PEEK, PEN, PAR, woven fiberglass, aluminum, or composites made of such materials. Thus, in some instances, diaphragm may include a dielectric surface 308, e.g., a front or a back surface, extending between the diaphragm edges supported by frame. Dielectric surface may be flat, as in the case of a planar diaphragm, or may be conical or curved, as in the case of a cone or dome diaphragm, or some combination of planar portion and curved portion as dictated by the design requirements. Diaphragm may be constructed entirely from a dielectric material, or a portion of the front or back surface of diaphragm may be coated with a dielectric material to form dielectric surface, as in the case of an aluminum diaphragm coated with a parylene film.

A voicecoil 310 may be integrated with diaphragm. More particularly, voicecoil may be formed from electrical wiring disposed on, and running over or along, dielectric surface of diaphragm. The electrical wiring may form one or more conductive windings 312 on diaphragm. More generally, conductive windings 312 may be conductive paths, e.g., wires, traces, etc., that convey electrical current. Thus, while the conductive paths are referred to throughout the following description as conductive windings, wire segments, etc., it shall be understood that conductive windings 312 may be any conductive material formed using known techniques to permit current to flow in a given direction relative to a corresponding magnetic field such that a Lorentz force is generated to move the conductive windings 312 and any substrate to which the windings are attached, e.g., a diaphragm. A conductive winding 312 may have one or more turns within an outer perimeter of diaphragm 304, i.e., the conductive winding 312 may run continuously along and entirely over a surface of diaphragm 304. As such, each turn may be separated from the perimeter of diaphragm 304 by a distance such that the turns are suspended inward from frame 302 on a moveable portion (along a central axis) of diaphragm 304. The turns may include a winding segment parallel to a longitudinal axis of a corresponding magnetized portions 318, e.g. a winding length, and a winding segment transverse to the longitudinal axis, e.g., a winding width.

Each conductive winding may be a portion of voicecoil that includes one or more loops running along dielectric surface. Each loop may have an outer profile or perimeter that is within an outer perimeter of diaphragm 304, i.e., each loop may run continuously along and entirely over a surface of diaphragm 304. Furthermore, the respective loops of each conductive winding may be coplanar. For example, a conductive winding may have several loops that are continuously formed in a spiral from an outer loop with a larger diameter to an inner loop with a smaller diameter. All of the loops may be within a coil plane. Furthermore, the coil plane may be parallel to the surface of diaphragm, and thus, the loops may run around and surround an axis that runs orthogonal to the coil plane. The conductive windings may be formed on diaphragm by printing or etching the windings on dielectric surface using known manufacturing techniques.

Each coil may be formed with alternative topologies that do not include loops. For example each coil may include wire segments that are adjacent but do not directly form a loop as long as the current in each segment runs in the proper direction for sufficiently useful Lorentz force. The wire segments or turns may be generally centered over a portion of the magnet array where the magnetic field lines are coplanar with the plane of the windings, wire segments, turns, etc.

In an embodiment, the conductive windings of voicecoil may be in series with one another. For example, a first conductive winding may be electrically connected to an electrical lead 314, e.g., a positive lead, and a second conductive winding may be electrically connected to another electrical lead 314, e.g., a negative lead, and the positive lead and the negative lead may be electrically connected through the first and second conductive windings. Alternatively, the conductive windings may be electrically connected in parallel. An alternate embodiment consists of effectively forming multiple voicecoils on diaphragm since each set of conductive windings may be separately actuated, i.e., be subjected to different electrical currents through different electrical circuits. The electrical leads 314 may extend from the conductive windings 312 suspended inward from frame 302 to the outer perimeter of diaphragm 304, and thus, may traverse the distance between the turns of conductive windings 312 and the outer perimeter or edge of diaphragm 304. A combination of these connections (series-parallel) may also be used.

Frame 302 may support diaphragm relative to magnetic arrays, and more particularly, may support a substrate 316 that holds magnetic arrays. Frame may hold substrate around an edge of the substrate, and each magnetic array may be located on a face of substrate such that a top face of the magnetic arrays is facing toward a respective conductive winding of voicecoil. Substrate may be a material that is rigid enough to support the magnetic arrays. For example, substrate may be a metal or polymer, e.g., acrylonitrile butadiene styrene (ABS) or aluminum. Beneficially, since the Halbach magnetic arrays inherently generate a magnetic field that is strongest on the top face opposite from the bottom face adjacent to substrate, substrate may be formed from either nonmagnetic or ferromagnetic material without disrupting the magnetic field applied to the voicecoil during speaker driving.

Each magnet array on substrate may include several magnetized portions 318. The magnetized portions may be magnetized by individually exposing different regions of a sheet of magnetic material, e.g., powdered ferrite in a binder, to different magnetic field. Alternatively, the magnetized portions may be separate magnets, e.g., magnetic bars, which are magnetized in different directions and then arranged side-by-side to effectively form a flat magnetic array with a rotating magnetic field. The effect of such rotating magnetic field is described in greater detail below.

Figure 4:
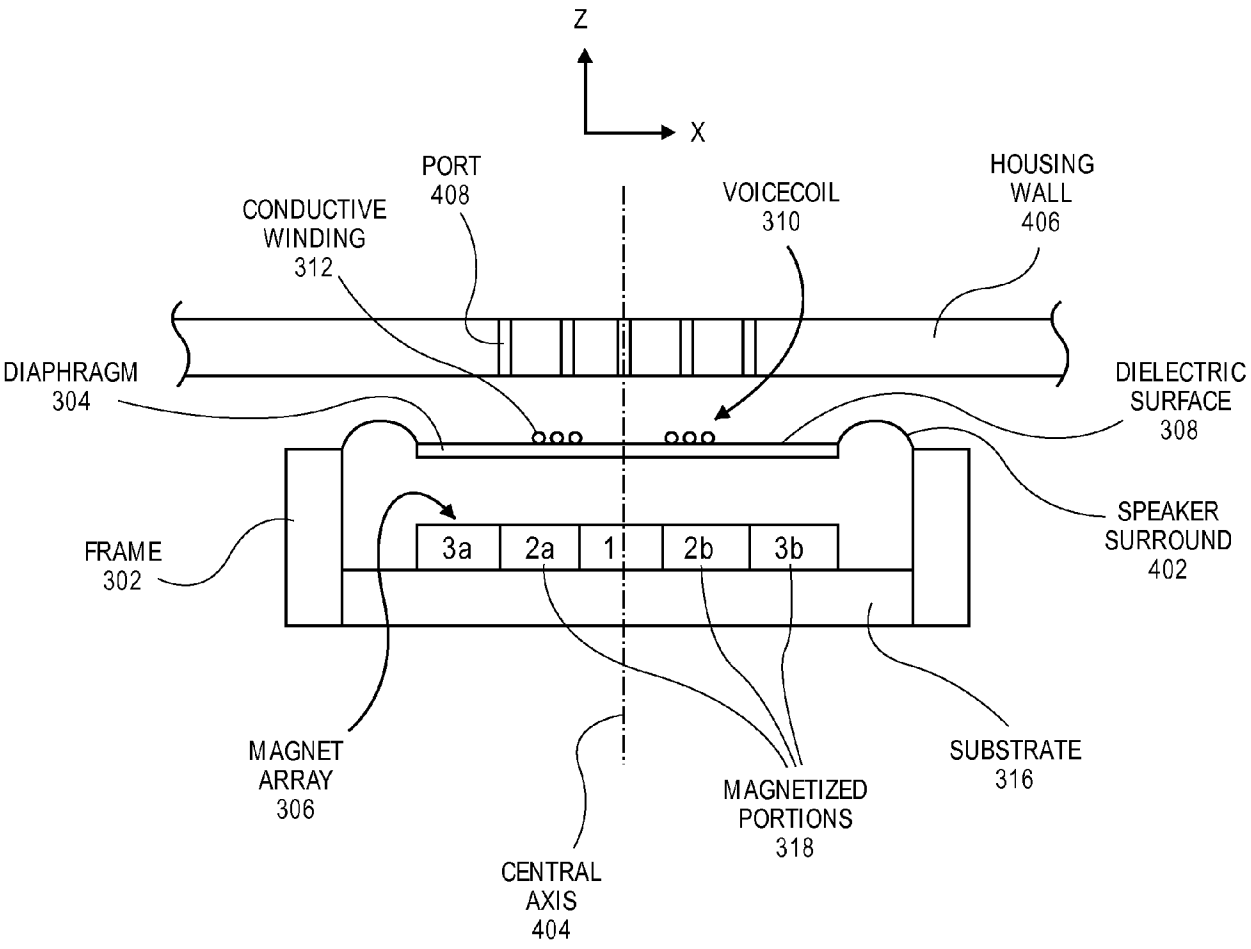
FIG. 4 is a sectional view of an audio speaker having a voicecoil running along a diaphragm surface within a fringe flux of a magnetic array in accordance with an embodiment.

Referring to FIG. 4, a sectional view of an audio speaker having a voicecoil running along a diaphragm surface within a fringe flux of a magnetic array is shown in accordance with an embodiment of the invention. An example of a microspeaker having a single voicecoil module including a conductive winding paired with a magnetic array is shown for simplicity, although multiple modules may be used. Diaphragm and magnetic array may be supported relative to one another by frame and one or more intermediate components, such as a speaker surround 402 that supports diaphragm relative to frame. Furthermore, diaphragm and magnetic array may be arranged relative to a central axis 404 such that dielectric surface and a top face of magnetic array are orthogonal to central axis. More particularly, conductive winding of a voicecoil module may be wound around central axis such that the loops form a planar winding, e.g., spiraling from an outer dimension to an inner dimension. The planar winding may be parallel to the arrangement of magnetic portions, which may similarly be arranged in a side-by-side fashion linearly along substrate such that a longitudinal axis of each magnetized portion (as well as a transverse axis running orthogonal to the longitudinal axes through all of the magnetized portions) are orthogonal to central axis. As such, a magnetic field generated by the magnetic array, when it is directed upward along central axis, shall be directed toward conductive winding of voicecoil. Thus, when the microspeaker is located within a device such that central axis runs through magnetic array and diaphragm toward a housing wall 406 of the device, when voicecoil is actuated by applying an electrical current through conductive windings, voicecoil drives diaphragm to generate sound that is emitted forward along central axis through a port 408 in housing wall 406 into a surrounding environment. To aid in the following description, magnetized portions 318 may be labelled symmetrically about a middle magnetized portion centered below voicecoil 310 along central axis 404. For example, the middle magnetized portion may be labelled "1" with magnetized portions toward the left of "1" being labelled "2*a*", "3*a*", etc. and magnetized portions toward the right of "1" being labelled "2*b*", "3*b*", etc.

Referring to FIG. 5A, a sectional view of an audio speaker having a voicecoil running along a diaphragm surface within a fringe flux of a Halbach array is shown in accordance with an embodiment. As described above, conductive winding of voicecoil may be arranged as planar coils on diaphragm. Conductive windings may be on a top face of diaphragm, i.e., above or in front of a dielectric surface, on a bottom face of diaphragm, i.e., below or behind a dielectric surface, or distributed on both sides of the diaphragm plane. In either case, conductive winding may be considered to run over dielectric surface. Diaphragm may have a thickness on the order of 20 micron, and thus, whether conductive winding is on a top face or a bottom face of diaphragm, the winding may be at least partially within a magnetic field generated by a corresponding magnetic array.

Magnetic array may be located below diaphragm. For example, magnetic array may be separated from diaphragm by a distance on the same order as the excursion limit of the microspeaker. That is, in the case of a high-frequency microspeaker, e.g., a "tweeter", diaphragm may travel 0.1 mm in either direction, and thus, magnetic array may be spaced apart from diaphragm by at least 0.1 mm, e.g., 0.25 mm, to reduce the likelihood that diaphragm will crash into magnetic array. Similarly, in the case of a mid-range or full-range microspeaker, diaphragm may travel 1.0 mm in either direction, and thus, magnetic array may be spaced apart from diaphragm by at least 1.0 mm, e.g., 1.15 mm. In the case of a tweeter, diaphragm may be pinned, e.g., bonded, directly to frame, whereas the larger travel of a mid-range or full-range microspeaker may necessitate a more flexible speaker surround or suspension element between diaphragm and frame.

Magnetic array may be disposed on substrate to create the magnetic field that engulfs at least a portion of voicecoil on diaphragm. More particularly, magnetic field may have an upper magnetic field 502 that is directed from magnetic array toward voicecoil and a lower magnetic field 504 that is directed from magnetic array toward substrate. The upper magnetic field generated by magnetic array is configured to have a fringe flux 506, i.e., a flux region within which upper magnetic field follows field lines that are parallel to dielectric surface. Thus, the radial component of upper magnetic field within fringe flux may be in the same plane as conductive winding.

Figure 6:
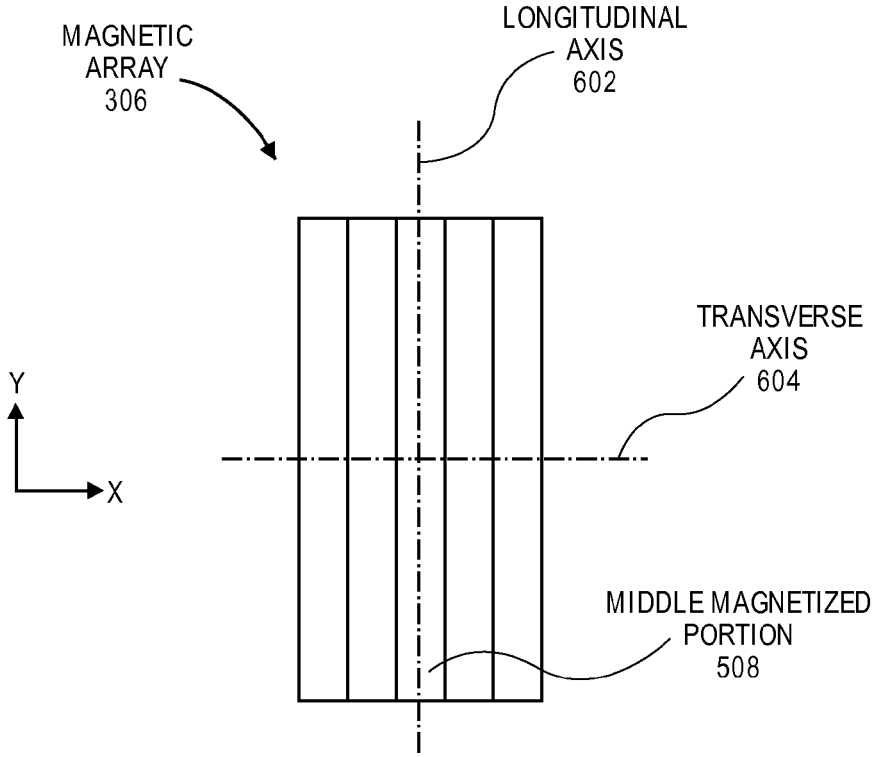
FIG. 6 is a front view of a magnetic array having a rectangular profile in accordance with an embodiment.

Referencing FIG. 6, magnetic array may include several magnetized portions having spatially rotating patterns of magnetization within each five-magnet Halbach array. For example, magnetic array 306 may include a middle magnetized portion 508 with a magnetic field perpendicular to a longitudinal axis such that the magnetic field is directed upward along central axis +Z orthogonal to dielectric surface. Moving to the right of middle magnetized portion, each sequential magnetized portion may have a magnetic field rotated 90 degrees counterclockwise to the magnetic field of middle magnetized portion. For example, the adjacent magnetized portion to the right of middle magnetized portion may direct a magnetic field toward the longitudinal axis of middle magnetized portion in the −X direction. Similarly, the next rightward magnetized portion may direct a magnetic field downward toward substrate in the −Z direction.

Moving to the left of middle magnetized portion, each sequential magnetized portion may have a magnetic field rotated 90 degrees clockwise to the magnetic field of middle magnetized portion. For example, the adjacent magnetized portion to the left of middle magnetized portion may direct a magnetic field toward the longitudinal +X axis of middle magnetized portion. Similarly, the next leftward magnetized portion may direct a magnetic field downward toward substrate in the −Z direction. When the magnetic field from each magnetized portion has similar magnitude, the resulting magnetic flux from the magnetic array becomes substantially one-sided, in that upper magnetic field is reinforced, or multiplied, while lower magnetic field is cancelled or reduced as compared to upper magnetic field. Thus, magnetic field generated by magnetic array may be confined to the side facing diaphragm. In an embodiment, the side of the array where the field is reinforced generates a magnetic field composed of loops of alternating polarity which emanate from the middle magnetized portion, curve along a path passing over the magnets poled in the + and −X directions, and eventually return to the magnets on the outermost portion of the array.

In an embodiment, magnetic array include three magnetized portions, e.g., middle magnetized portion and an adjacent magnetized portion on both sides of middle magnetized portion, which form a three-magnet Halbach array. In an embodiment, as shown in FIG. 5A, magnetic array may have at least five magnetized portions to form a Halbach array that more effectively cancels lower magnetic field and intensifies the upper magnetic field. In other embodiments, the rotating magnetization pattern may be continued to form a magnetic array with several Halbach arrays, e.g., there may be fifteen magnetized portions forming three separately spaced Halbach arrays as shown in FIG. 3A. Each Halbach array may be paired with a respective conductive winding to form a voicecoil module, and the Halbach array may represent a single cell of magnetic array. In another embodiment, several cells, e.g., several Halbach arrays, may be arranged side-by-side to form magnetic array. Furthermore, the cells may share a magnetized portion. For example, a first Halbach array and a second Halbach array may be adjacent to one another and share a magnetized portion that directs a magnetic field toward substrate. The shared magnetized portion may be a right-most magnetized portion of the first Halbach array and a left-most magnetized portion of the second Halbach array. Thus, a magnetic array may include two Halbach arrays having a total of nine magnetized portions. Multiple cells having this pattern may be continued in a transverse direction to scale the magnetic array and transducer to any size. For example, magnetic array may have several cells arranged side-by-side such that a transverse dimension of magnetic array is equal to a transverse length of the diaphragm size desired for the application.

Figure 5B:
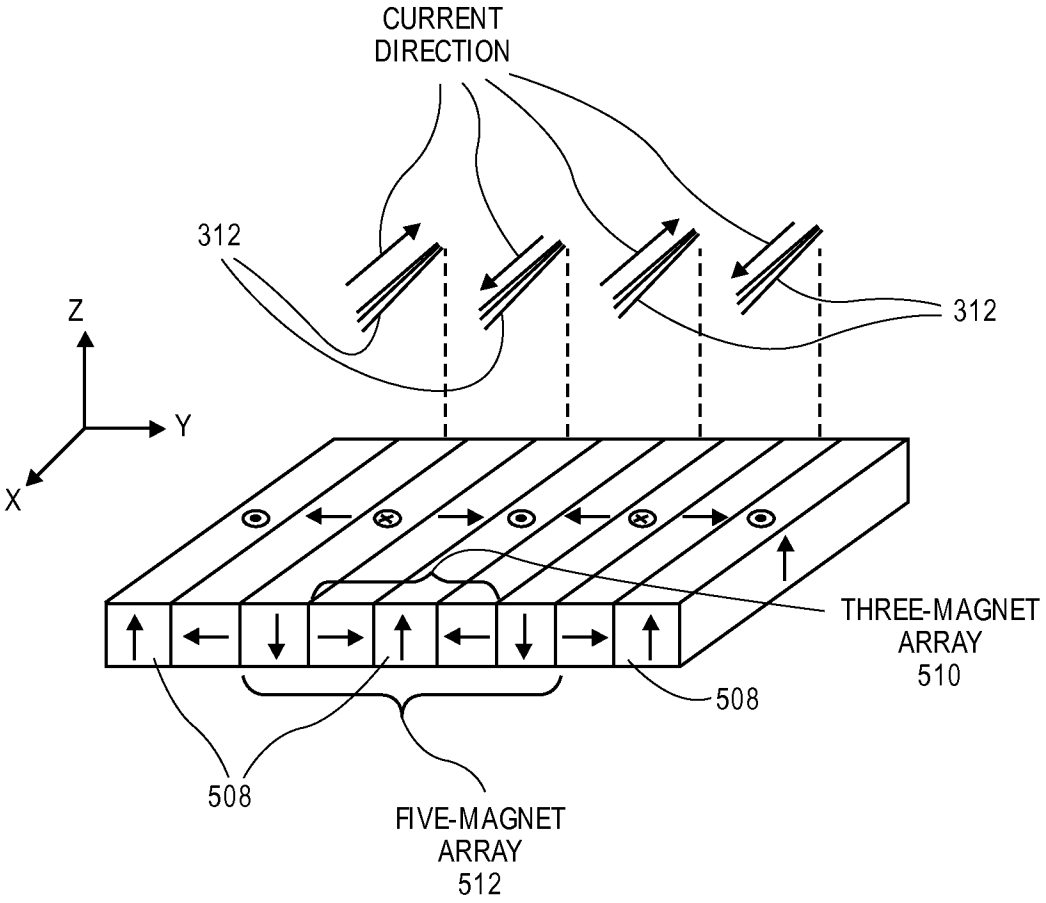
FIG. 5B is a sectional view shown in perspective of a magnetic array having several Halbach arrays directing a magnetic field toward a voicecoil in accordance with an embodiment.

Referring to FIG. 5B, a sectional view is shown in perspective of a magnetic array having several Halbach arrays directing a magnetic field toward a voicecoil in accordance with an embodiment. A magnetic array may include three or more magnets forming an individual or composite Halbach array. For example, the nine magnetized portions shown may be arranged side-by-side with one or more three-magnet array 510 or five-magnet array 512 forming the overall magnet array structure. Arranging magnetic arrays side-by-side in such a manner may allow for the magnetic array to be extended to any desired length or width. Such a magnet array structure may be used in place of the magnet array shown in FIG. 3, which includes several magnetic array cells spaced apart from one another. As shown, since the magnetic array may include adjacent magnetic array cells, i.e., cells located side-by-side, the adjacent cells may share a magnetized portion. For example, middle magnetized portions 508 may form the center of a three-magnet array 510 or five-magnet array 512, and the respective cells may share a magnetized portion having a downward directed magnetic field that is half-way between another middle magnetized portion 508 in the magnetic array structure. As shown by the dotted lines, the magnetized portions adjacent to each middle magnetized portion 508 may be essentially centered below a respective conductive winding 312, such that the magnetic field direction imposed by the adjacent magnetized portion is orthogonal to the flow of current in the respective conductive winding 312 to cause a Lorentz force on the conductive winding 312. More particularly, based on the right-hand rule, the Lorentz force may act in the same direction as other Lorentz forces caused by other adjacent magnetized portions on respective conductive windings 312 to move the diaphragm along the central axis.

Figure 5C:
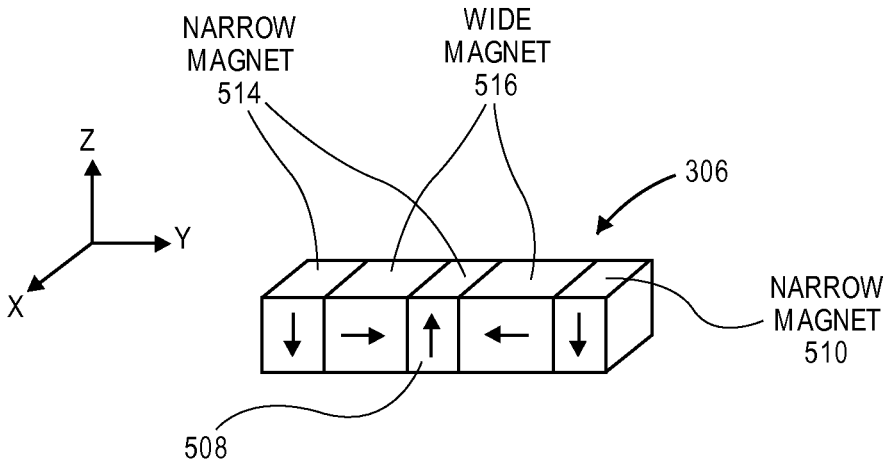
FIG. 5C is a sectional view shown in perspective of a magnetic array having asymmetric magnets in accordance with an embodiment.

Referring to FIG. 5C, a sectional view is shown in perspective of a magnetic array having asymmetric magnets in accordance with an embodiment. Magnetic array may be composed of magnets with varying cross-sectional dimensions. For example, magnetized portions may be wider or narrower than other magnetized portions in the magnetic array. As an example, middle magnetized portion 508 may be a narrow magnet 514 having a magnet width that is shorter than a width of wide magnets 516 on either side of middle magnetized portion 508. Furthermore, each magnetized portion adjacent to wide magnets 516 may be a narrow magnet 514. As such, magnetic array may be composed of uniformly alternating magnet widths, e.g., narrow magnet 514 followed by wide magnet 516 followed by narrow magnet 514, and so on. In other embodiments, the magnet pattern may be non-uniform or have more than two specific widths. For example, middle magnetized portions 508 may have a first width, magnetized portions with sideways poled magnetic fields may have a second width, and magnetized portions with downward poled magnetic fields may have a third width. In an embodiment, the width of middle magnetized portions 508 may decrease laterally from the centermost middle magnetized portion 508, i.e., the middle magnetized portion 508 at a center of diaphragm 304 may be wider than the middle magnetized portions 508 near the lateral edges of diaphragm 304.

Figure 5D:
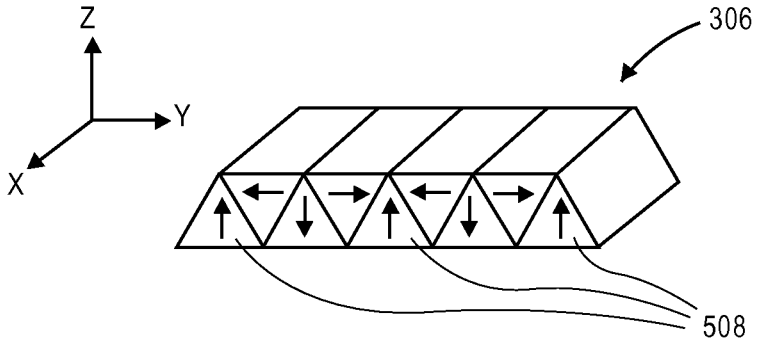
FIG. 5D is a sectional view shown in perspective of a magnetic array having triangular magnets in accordance with an embodiment.

Referring to FIG. 5D, a sectional view is shown in perspective of a magnetic array having triangular magnets in accordance with an embodiment. In addition to having varying dimensions, magnetized portions of magnetic array 306 may have different shapes or orientations. For example, magnetic array 306 may include magnets having triangular cross-sections. The non-rectangular cross-sections of the magnets may mesh together. For example, the apices of some triangular magnetized portions, e.g., middle magnetized portions 508 or magnetized portions having downward poled magnetic fields, face upward while the apices of other magnetized portions, e.g., magnetized portions having sideways poled magnetic fields, face downward. As such, the triangles may assemble in a meshed configuration such that a closely packed magnetic array structure having a sheet-like outer appearance is formed.

Referring to FIG. 6, a front view of a magnetic array having a rectangular profile is shown in accordance with an embodiment. In an embodiment, magnetic array may have a rectangular top face. For example, magnetic array may include a Halbach array having five magnetized portions, and each magnetized portion may be a separate bar magnet have a rectangular cross-sectional area extruded along a longitudinal axis 602. For example, middle magnetized portion may be a bar magnet or a magnet rod having a rectangular, e.g., square, cross-sectional area. A magnet rod may have sides, i.e., a rod height and a rod width, with dimensions in a range of between 0.5 to 6 mm for typical audio applications, and in some cases 1 mm, although the concept is valid in theory for any scale subject to manufacturing limitations and tolerances. Since the Halbach structure is scalable, individual magnets may be made as small or large as desired. Magnetic finite element simulations indicate only a weak dependence of the permeance coefficient with magnet scale. For example, for an array composed of 5 bar magnets, each having a square cross section with dimensions of 2 mm×2 mm, the permeance coefficient is virtually the same (approximately 0.8) as the same array when each magnet is scaled down to a size of 0.25 mm×0.25 mm. This indicates that the practical limit for miniaturization of this array would be set by the practicalities of manufacturing and handling such small magnets, rather than by the magnetic properties. Middle magnetized portion may be a bar magnet or magnet rod extruded along longitudinal axis such that the length of the magnetized portion, e.g., the rod length, along longitudinal axis is greater than the dimension of any side of the cross-section of any individual magnet within the magnetized portion. In an embodiment, the extruded length may be the same length as diaphragm in a direction of longitudinal axis, e.g., in a range between 10 to 40 mm and in some cases 15 mm, although the concept is valid in theory for any scale subject to manufacturing limitations and tolerances. As described above, a length of magnetic array in a transverse direction orthogonal to longitudinal axis, i.e., in a direction of the side-by-side magnetized portions, may be limited only by the number of magnetized portions. For example, in a case in which magnetic array includes at least three magnetized portions arranged side-by-side and having cross-sectional widths of 1 mm, the magnetic array may have a length in the transverse direction along transverse axis 604 of 3 mm. However, the length in the transverse direction may be scaled up to any dimension by including more magnetized portions or more magnetic array cells having rotating magnetization patterns.

Figure 7A:
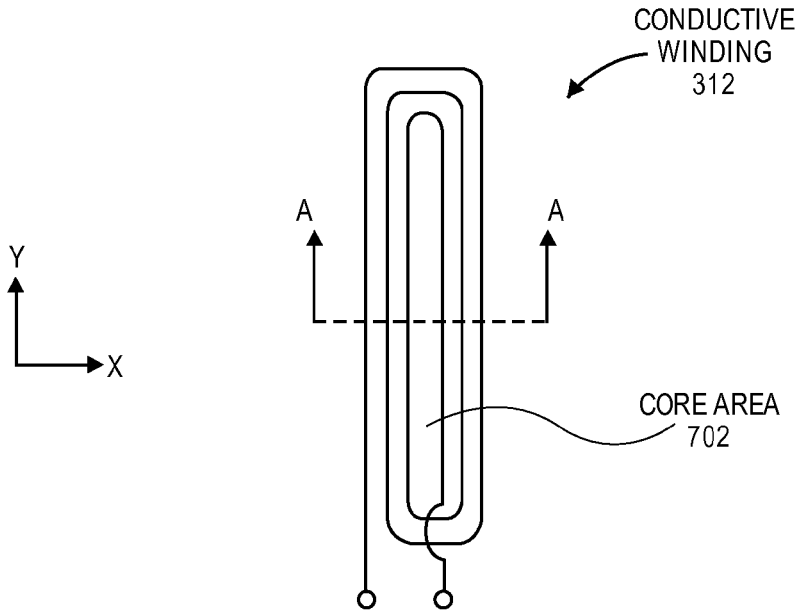
FIG. 7A is a front view of a voicecoil having a conductive winding running along a spiral path in accordance with an embodiment.
Figure 7B:
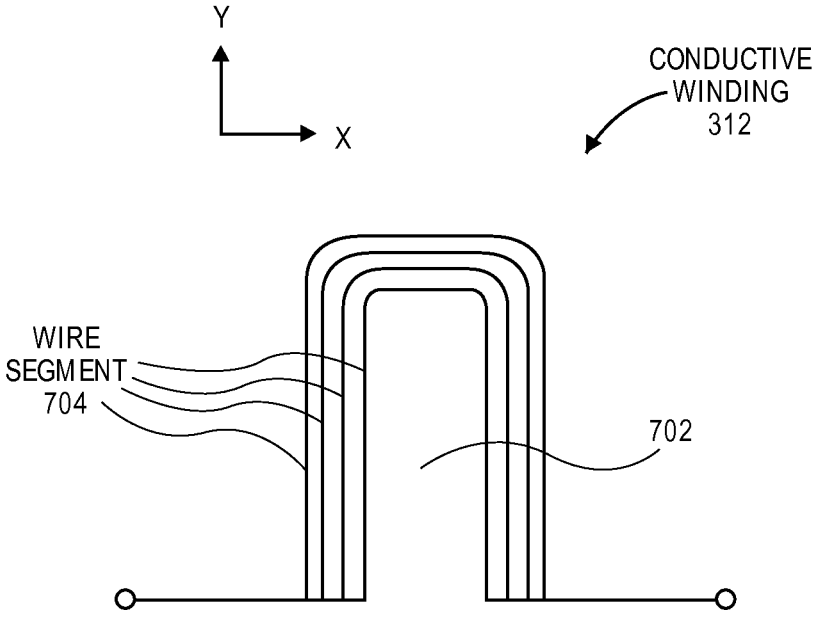
FIG. 7B is a front view of a voicecoil having a conductive winding with adjacent curvilinear conductive paths running in parallel in accordance with an embodiment.

Referring to FIG. 7A, a front view of a voicecoil having a conductive winding running along a spiral path is shown in accordance with an embodiment. In an embodiment, voicecoil includes one or more voicecoil modules having a conductive winding paired with magnetic array. The conductive winding may be paired with a magnetic array cell, such as the Halbach array shown in FIG. 6. Furthermore, conductive winding may be shaped such that upper magnetic field from the Halbach array includes fringe flux that passes through the same plane as the loops of conductive winding. For example, conductive winding may include a rectangular shape, e.g., a spiral of rectangular loops, having a winding length in the direction of longitudinal axis and a winding width in the direction of transverse axis. Alternatively, the coil itself may not be wound in a spiral fashion, but rather in a series of parallel traces as shown in FIG. 7B, all connected electrically in parallel. In an embodiment, the winding length in the direction of longitudinal axis may be on the same order of magnitude as the length of a paired magnetic array in the same direction, e.g., of a rod length of a magnetized portion. For example, the winding length may be almost the same length as a diaphragm length, e.g., in a range between 10 to 40 mm and in some cases 15 mm. The winding length may be longer than the winding width, e.g., in some cases the winding length may be at least twice as long as the winding width.

In an embodiment, the winding width of conductive winding in the direction of transverse axis may be wider than the cross-sectional rod width dimension of middle magnetized portion. As the conductors are advantageously placed in a centered fashion over the middle magnetized portion 508 in each Halbach array, there is a degree of freedom in the winding width relative to the width of the middle magnetized portion. For example, conductive winding may have a winding width of between about 90% to 200% of a rod width of middle magnetized portion, and in some cases between 100% to 120% of the rod width of middle magnetized portion in order to take maximal advantage of the flux linked in the plane of the windings. Thus, when middle magnetized portion has a rod width of 1 mm, conductive winding may have a winding width in the direction of transverse axis in a range between 1 to 1.2 mm.

As described above, conductive winding on dielectric surface may be a planar winding, and thus, a winding thickness, i.e., in a direction along central axis Z may be less than a length in either the longitudinal or transverse direction. For example, the winding thickness of conductive winding may be 0.5 mm or less in some cases. Thus, conductive winding may be both longer and wider than it is thick. For example, the winding width of conductive winding may be at least 20 times longer than the winding thickness of conductive winding, advantageously minimizing the Z height of the transducer.

In an embodiment, conductive winding includes a core area 702 around which the electrical wires of conductive winding are wound in a planar fashion. For example, conductive winding may form a spiral winding around a rectangular core area. Core area may be centered over middle magnetized portion of a respective magnetic array. For example, core area may be centered around central axis Z such that core area is centered above middle magnetized portion. In such case, fringe flux of upper magnetic field generated by magnetic array may pass parallel to the transverse portions of conductive winding. By contrast, fringe flux of upper magnetic field may pass perpendicular to the longitudinal portions of conductive winding. Accordingly, the length of the transverse portions of conductive winding may affect the driving of the diaphragm to a lesser degree than the length of the longitudinal portions of conductive winding, depending on the aspect ratio of the coil. The width of core area of conductive winding may therefore be minimized to increase the density of longitudinal portions of conductive winding over magnetic array. To improve heat dissipation, reduce power compression, and increase total acoustic output, the total planar area of the windings may be maximized, and other techniques may be incorporated into the material of the diaphragm, especially within the core area, to improve thermal conduction within the diaphragm itself. For example, the diaphragm may be doped with a filler such as Boron Nitride, or the diaphragm itself may be coated or constructed from a highly thermally conductive material such as various forms of graphite, graphene, etc. Ultimately, the maximum acoustic output may be limited by the allowable temperature rise of the moving diaphragm and coil assembly. Beyond this temperature limit, which is met when the limits of the materials and the manufacturing process is reached, permanent damage may occur. Likely failure modes may include failure of the substrate due to loss of tension in the diaphragm, failure of the bond between the conductor and the diaphragm leading to lifting of the traces from the substrate, or excessive current within the traces themselves that causes permanent conductor damage such as arcing that leads to an open circuit. Suitable dielectric materials for the diaphragm include polyimide film such as Dupont Kapton®, polyethelyne napthalate film such as Dupont Teonex®, or polyether ether ketone based film. These and other similar films or composite films with multiple layers may be considered based on properties such as maximum temperature range, damping characteristics, elastic modulus, ability to reliability attach conductors, and other key parameters.

FIG. 7B is a front view of a voicecoil having a conductive winding with adjacent curvilinear conductive paths running in parallel in accordance with an embodiment. In an embodiment, voicecoil may include one or more conductive windings that include a plurality of conductive paths running electrically in parallel over dielectric surface. For example, conductive winding 312 may include several wire segments 704 that follow a curvilinear path from a first electrode to a second electrode. Electrical current in each wire segment 704 may flow in the same direction, i.e., between the electrodes, and thus by placing the curvilinear paths adjacent to each other, the current path may approximate the path of a spiral winding having multiple loops or turns. In particular, the wire segments 704 may follow a curvilinear or multi-segmented conductive path that approximates a rectangle, "U" shape, circle, "C" shape, or similar annular arrangement around a core area 702. As in other embodiments, core area 702 may be centered along the central axis that passes through a middle magnetized portion 508 of an underlying magnetic array. That is, the wire segments 704 may be located within sideways directed magnetic field lines to cause a Lorentz force to move the conductive winding 312 and any substrate to which the winding is coupled, e.g., diaphragm 304.

Figure 8:
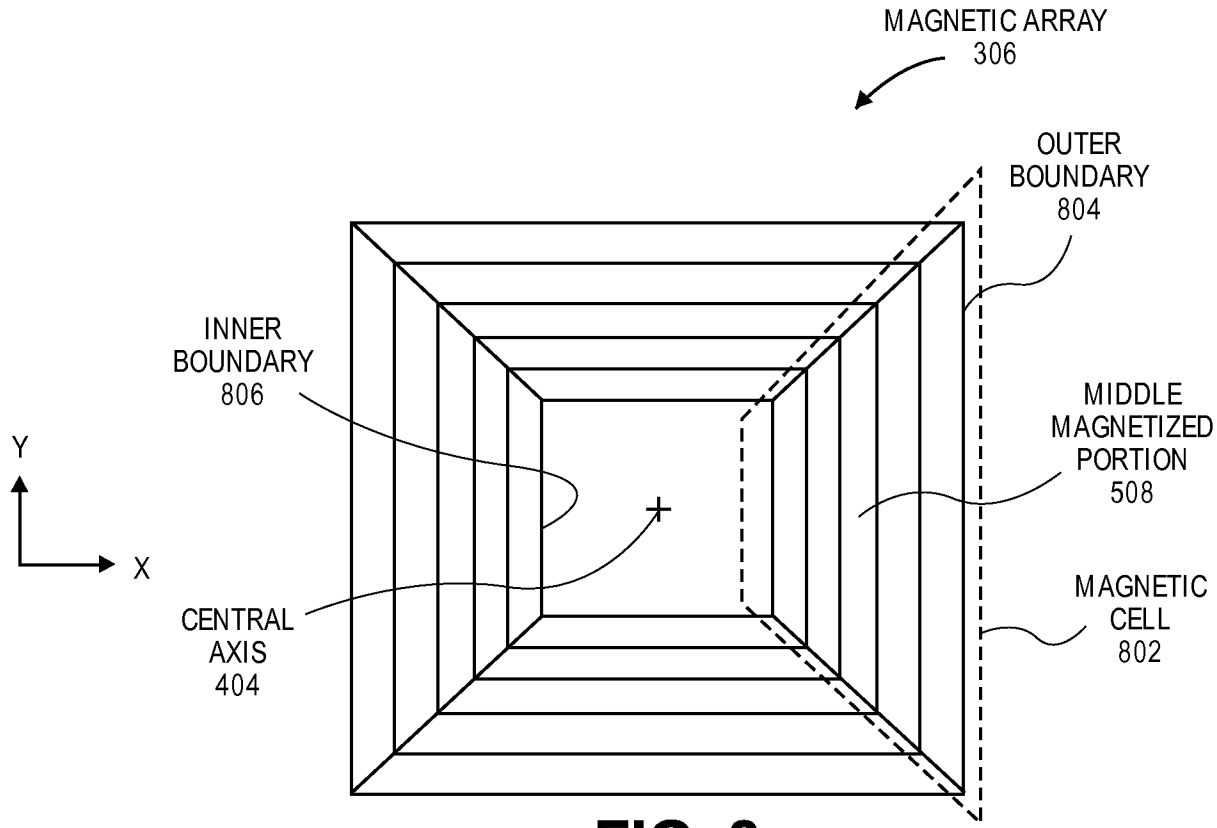
FIG. 8 is a front view of a composite magnetic array structure having several magnetic cells arranged in a rectangular pattern in accordance with an embodiment.

Referring to FIG. 8, a front view of a composite magnetic array structure having several magnetic cells arranged in a rectangular pattern is shown in accordance with an embodiment. In an embodiment, magnetic array may have a composite structure formed from several magnetic cells 802. For example, four magnetic cells, e.g., Halbach arrays, may be arranged about central axis to form a composite square structure. More particularly, each magnetized portion, e.g., middle magnetized portion may have a different length than an adjacent magnetized portion to form magnetic cells have trapezoidal profiles. The slanted edges of the trapezoids may therefore fit together to create a composite structure with a square outer boundary 804 and a square inner boundary 806 surrounding central axis.

Figure 9:
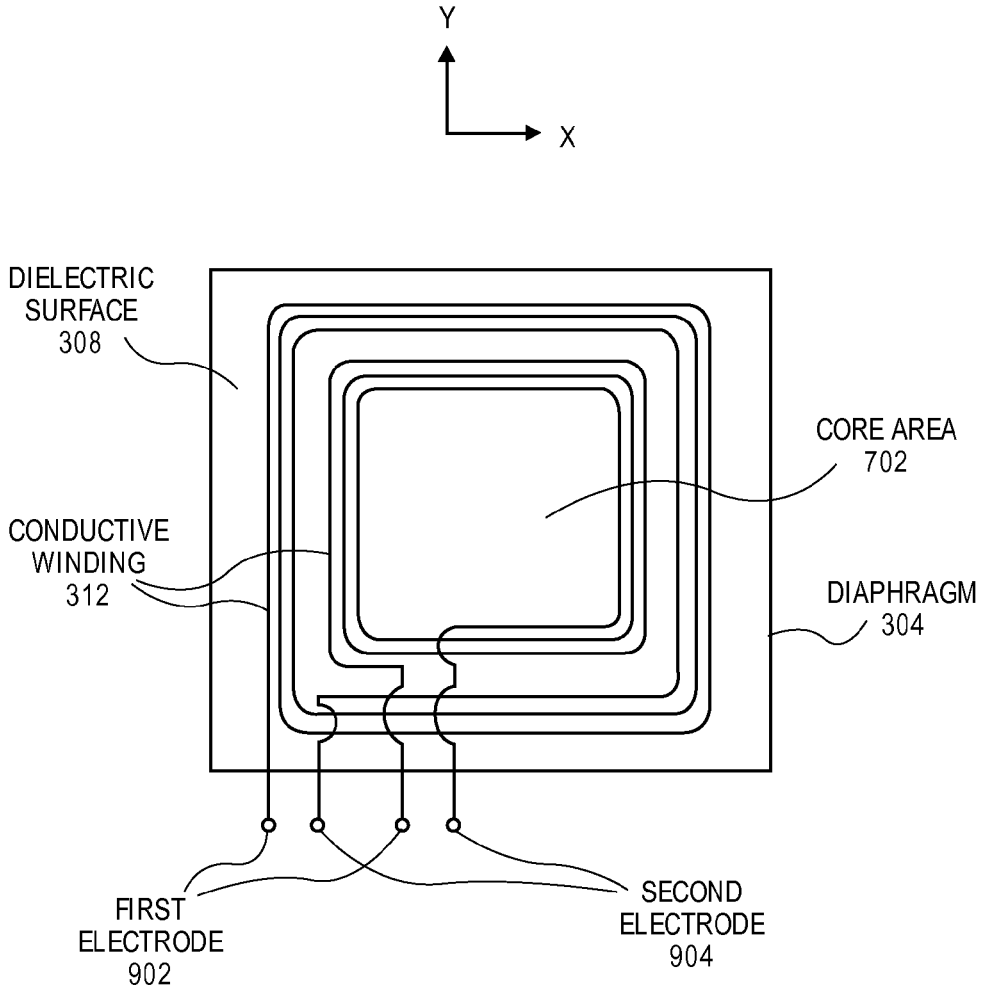
FIG. 9 is a front view of a voicecoil having a conductive winding running along a rectangular path matching a rectangular pattern of a composite magnetic array structure in accordance with an embodiment.

Referring to FIG. 9, a front view of a voicecoil having a conductive winding running along a rectangular path matching a rectangular pattern of a composite magnetic array structure is shown in accordance with an embodiment. Voicecoil may include a multiple conductive windings that spiral along dielectric surface of diaphragm in a shape similar to an underlying magnetic array, e.g., similar to the square composite magnetic array structure shown in FIG. 8. Accordingly, conductive windings may spiral inward from a first electrode 902 on diaphragm to a second electrode 904 on diaphragm along a square pattern around core area. Furthermore, core area may be centered over central axis of magnetic array such that the lengths of windings in both the longitudinal and transverse directions of conductive winding are parallel with the middle magnetized portions of magnetic array. For example, each length of conductive winding may be centered over a corresponding middle magnetized portion of a corresponding magnetic cell of magnetic array such that the corresponding upper magnetic field generated by the magnetic cell is directed upward toward the conductive winding length and the corresponding fringe flux of the upper magnetic field passes through the conductive winding along the surface plane of diaphragm. As a result, voicecoil with several conductive winding may be paired with a composite magnetic array structure to drive a diaphragm having a square or rectangular profile by energizing a single winding of voicecoil through first electrode and second electrode. As with the previous embodiments, the position of the windings may be placed over the regions of highest magnetic flux parallel to the plane of the windings, which may lead to non-uniform distribution of the coil windings over the surface of the diaphragm. For example, the outer conductive winding may be generally centered over the magnets labeled 2*a* in FIG. 4 and the inner conductive winding may be generally centered over the magnets labeled 2*b* in FIG. 4.

In an alternative embodiment, the multiple conductive windings 312 of FIG. 9 may be replaced by a single conductive winding 312 that includes two separate spiral sections placed in series. For example, a first spiral winding may include several loops that approximate an outer dimension of an outer rectangular composite magnet (corresponding to a magnet "2*b*" within the framework of FIG. 4) and a second spiral winding may include several loops that approximate an outer dimension of an inner rectangular composite magnet (corresponding to a magnet "2*a*" within the framework of FIG. 4). The outer winding and inner winding may be electrically in series such that electrical current through both winding sections is in the same direction, e.g., clockwise. As such, the outer winding segment may be connected at one end to first electrode 902 and at a second end to a first end of the inner winding segment, and the inner winding segment may include a second end connected to second electrode 904.

Figure 10:
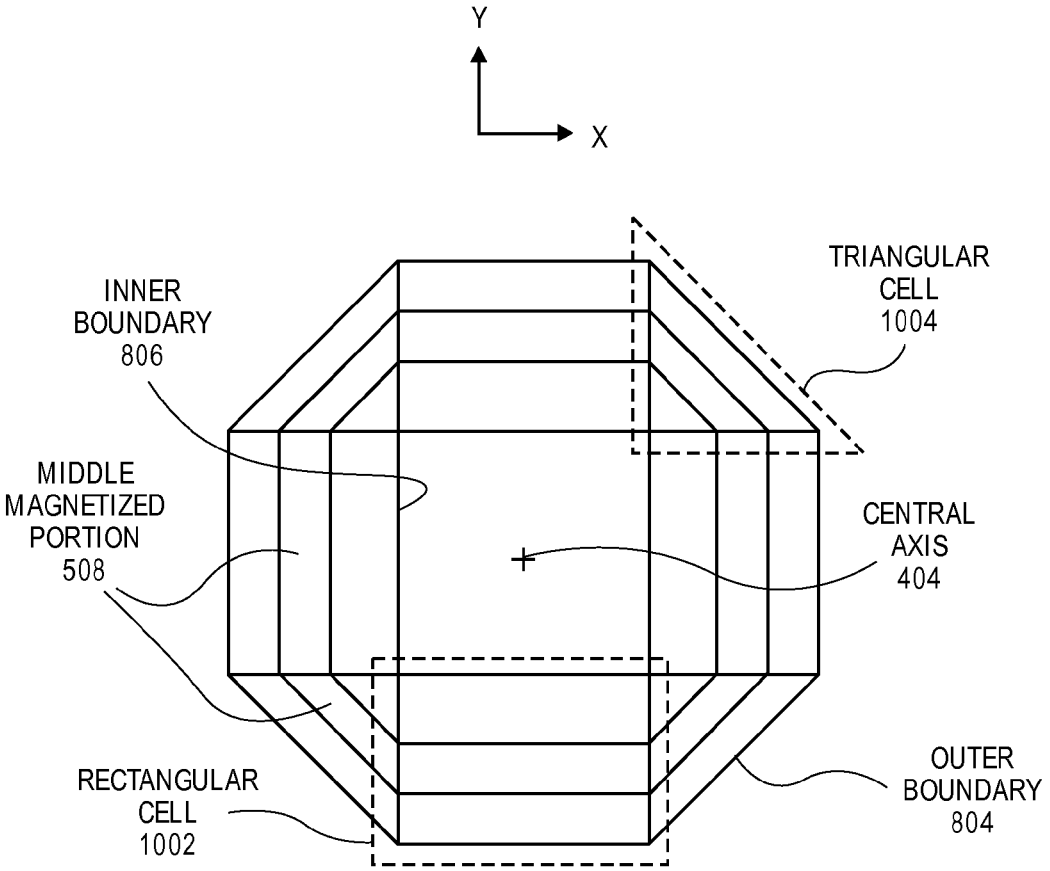
FIG. 10 is a front view of a composite magnetic array structure having several magnetic cells arranged in an octagonal pattern in accordance with an embodiment.

Referring to FIG. 10, a front view of a composite magnetic array structure having several magnetic cells arranged in an octagonal pattern is shown in accordance with an embodiment. The composite magnetic array structure shown in FIG. 8 is not limiting, and for example, additional magnetic cells may be fit together to create a composite structure that approximates a cylindrical or annular magnetic array. In an embodiment, four rectangular cells 1002 and four triangular cells 1004 may be arranged in a composite structure having an octagonal outer boundary and a square inner boundary around central axis. Each rectangular cell may include at least three magnetized portions arranged side-by-side and having equal lengths in a longitudinal direction. Each triangular cell may include at least three magnetized portions arranged side-by-side and having different lengths in a longitudinal direction. More particularly, the magnetic cells may include magnetized portions, e.g., middle magnetized portions, extending along respective longitudinal directions with ends that meet to form the composite magnetic array structure circumscribing central axis. In an embodiment, more magnetic cells may be included to form a composite magnetic array structure with a more smooth transition, i.e., less angularity, between path sections. That is, by including more magnetic cells, the composite structure may approximate a circle, i.e., a path having a constant radius around central axis.

Figure 11:
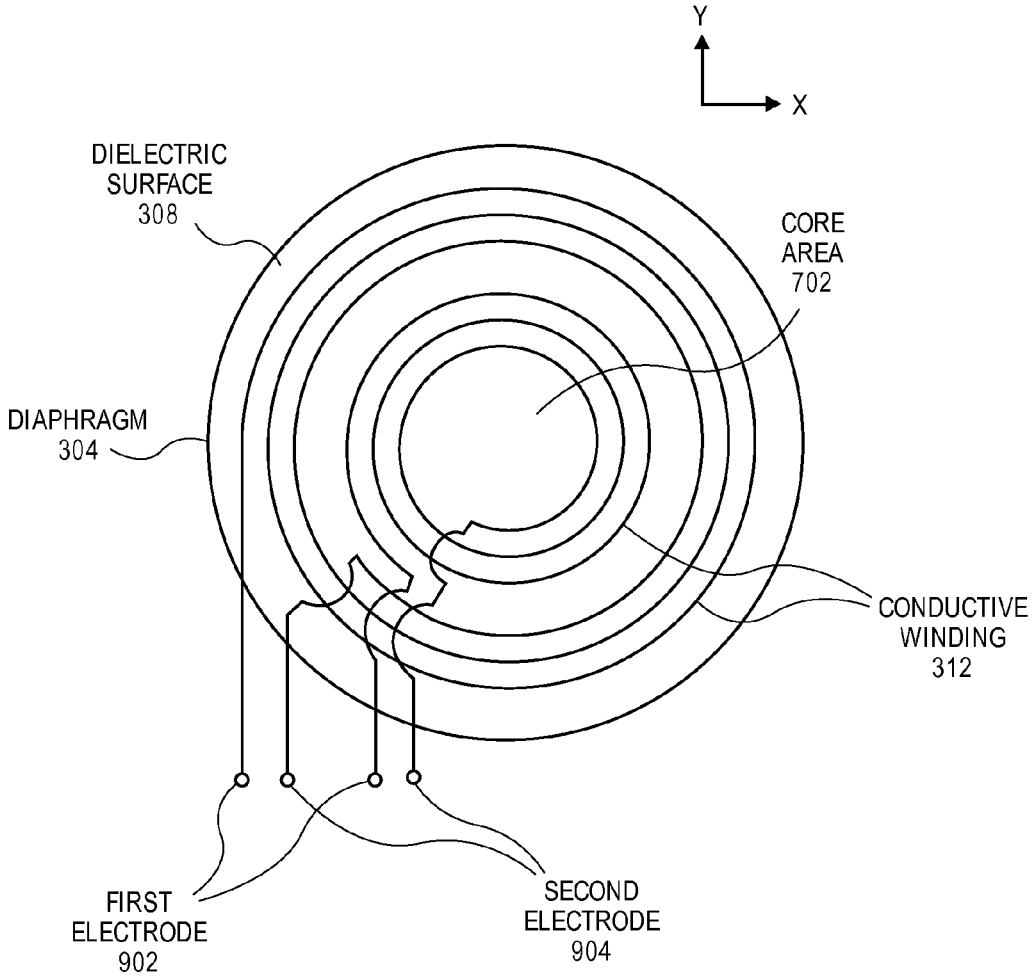
FIG. 11 is a front view of a voicecoil having a conductive winding running along a circular path matching a circular pattern of a composite magnetic array structure in accordance with an embodiment.

Referring to FIG. 11, a front view of a voicecoil having a conductive winding running along a circular path matching a circular pattern of a composite magnetic array structure is shown in accordance with an embodiment. Voicecoil may include multiple conductive windings that spiral along dielectric surface of diaphragm in a shape similar to an underlying magnetic array, e.g., similar to the circular approximation of the octagonal arrangement of magnets in the composite magnetic array structure shown in FIG. 10. Accordingly, conductive windings may spiral inward from a first electrode on diaphragm to a second electrode on diaphragm along a circular pattern around core area. Furthermore, core area may be centered over central axis of magnetic array such that conductive winding is located above middle magnetized portions of the underlying magnetic array. Thus, the upper magnetic field generated by the magnetic cell may be directed upward toward the conductive winding and the corresponding fringe flux of the upper magnetic field passes through the conductive winding along the surface plane of diaphragm. As a result, voicecoil with several conductive windings may be paired with a composite magnetic array structure to drive a diaphragm having a circular profile by energizing multiple windings of voicecoil through first electrode and second electrode. As with the previous embodiments, the position of the windings may be placed over the regions of highest magnetic flux parallel to the plane of the windings, which may lead to non-uniform distribution of the coil windings over the surface of the diaphragm. For example, the outer conductive winding may be generally centered over the magnets labeled 2*a* in FIG. 4 and the inner conductive winding may be generally centered over the magnets labeled 2*b* in FIG. 4.

In an alternative embodiment, the multiple conductive windings 312 of FIG. 11 may be replaced by a single conductive winding 312 that includes two separate spiral sections placed in series. For example, a first spiral winding may include several loops that approximate an outer dimension of an outer circular (or octagonal) composite magnet (corresponding to a magnet "2*a*" within the framework of FIG. 4) and a second spiral winding may include several loops that approximate an outer dimension of an inner circular (or octagonal) composite magnet (corresponding to a magnet "2*b*" within the framework of FIG. 4). The outer winding and inner winding may be electrically in series such that electrical current through both winding sections is in the same direction, e.g., clockwise. As such, the outer winding segment may be connected at one end to first electrode 902 and at a second end to a first end of the inner winding segment, and the inner winding segment may include a second end connected to second electrode 904.

Figure 12:
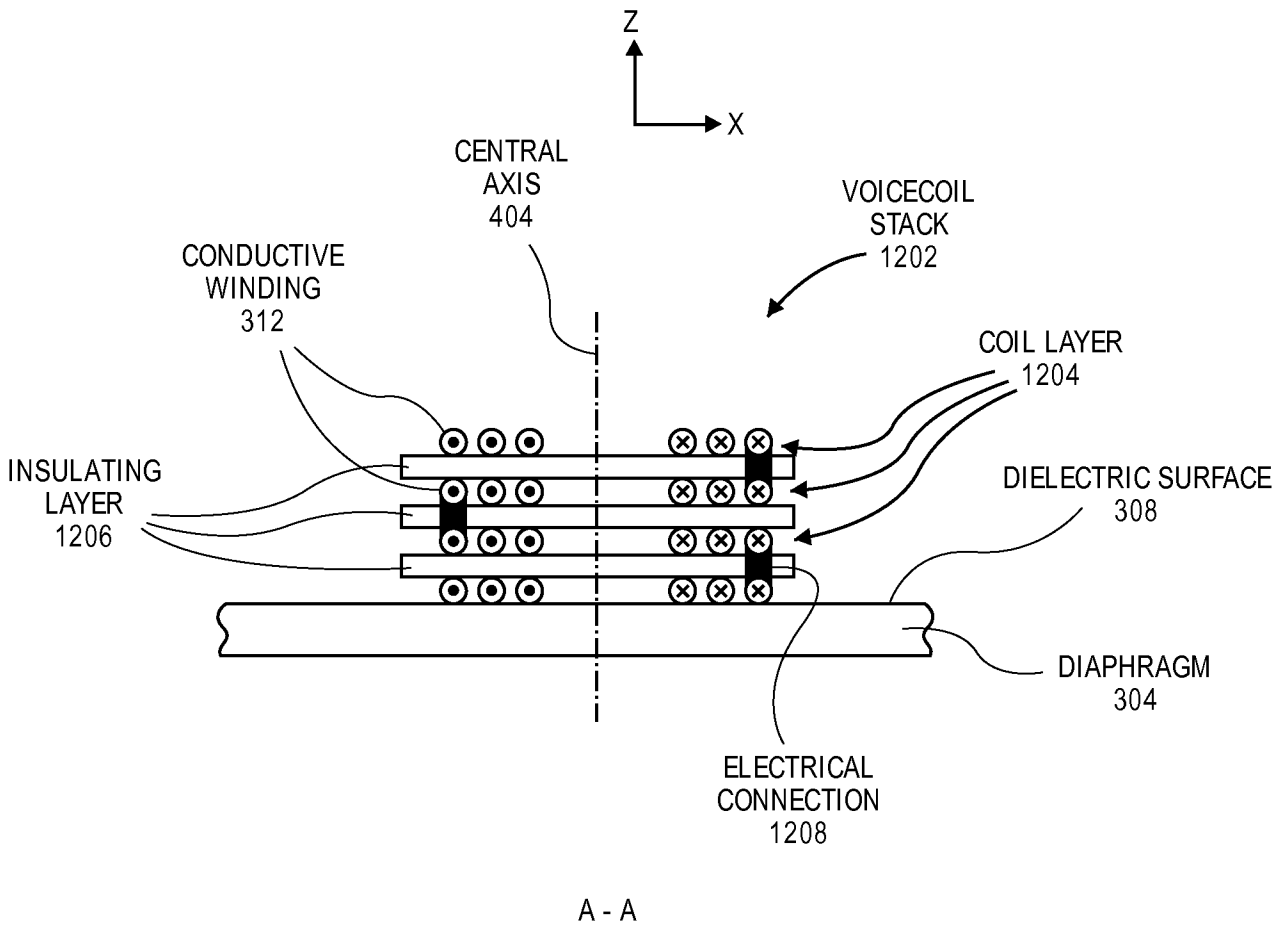
FIG. 12 is a cross-sectional view, taken about line A-A of FIG. 7A, of a voicecoil stack having several conductive windings or printed traces in respective coil layers separated from each other by intermediate insulating layers in accordance with an embodiment.

Referring to FIG. 12, a cross-sectional view taken about line A-A of FIG. 7A, of a voicecoil stack having several conductive windings in respective coil layers separated from each other by intermediate insulating layers is shown in accordance with an embodiment. In an embodiment, a density of conductive turns within a given volume may be increased by stacking several conductive windings. For example, voicecoil may include a voicecoil stack 1202 over dielectric surface of diaphragm. Voicecoil stack may include several planar conductive windings, e.g., spiral windings, located at different locations along central axis. For example, each conductive winding may spiral within a separate coil layer 1204 spanning a plane that lies orthogonal to central axis. Furthermore, the coil layers may be separated from each other by one or more insulating layers 1206, or alternatively, the electrical insulation may result from each wire or trace being individually insulated prior to placement on the diaphragm surface. The insulating layers may be formed from a thin dielectric material and be on the order of a few microns, for example.

In an embodiment, respective core areas of each conductive winding may be centered relative to each other and relative to central axis. Thus, a conductive winding of one coil layer may located above a conductive winding of an adjacent coil layer and therefore may be engulfed within the same region of magnetic flux generated by an opposing magnetic array. Furthermore, the conductive windings of different coil layers may be electrically connected in series such that application of an electrical current to first electrode that connects to a base conductive winding results in the electrical current travelling through each coil layer to second electrode that connects to a top conductive winding. Electrical connection 1208 between each conductive winding may be achieved through one or more electrical connections, e.g., electrical leads, vias, etc., that extend from a conductive winding of one coil layer around or through an insulating layer to a conductive winding of an adjacent coil layer. Connections and windings may be oriented such that the electrical current flows around central axis in the same direction within each coil layer, and thus, mechanical force induced by each winding is additive rather than subtractive.

Voicecoil stack may include as many or as few coil layers as needed to provide the desired winding density and/or electrical resistance. More particularly, voicecoil stack may balance manufacturability with more conductive windings to result in a voicecoil that applies adequate force to diaphragm when energized by an electrical current. For example, voicecoil stack may have two or more planar conductive windings. For manufacturability reasons, it may be beneficial to provide voicecoil stack having a number of conductive windings separated by insulating layers, which is evenly divisible by two in order to avoid having crossover leads, e.g., one or more connections that must pass from the inside of the core to the outside to make the desired electrical connection on the outer periphery of the coil. That is, in an embodiment, voicecoil stack includes a multiple of two coil layers having integrated conductive windings. In general, the most efficient driver may be constructed by minimizing the number of layers in the stack to minimize the moving mass, but additional layers may be desirable to affect the electrical properties such as the resistance or inductance desired in the final design, or the mechanical properties such as lowering the mechanical resonance by adding mass, for example. The conductor traces may be made from a variety of electrically conductive materials as commonly known in the art, including aluminum, copper, silver, or other alloys with special properties such as Al Mg (3.5%) which may exhibit a low thermal coefficient of resistance. In an embodiment, aluminum based alloys provide efficient performance via a high conductivity to mass ratio as compared to some common metals.

Figure 13:
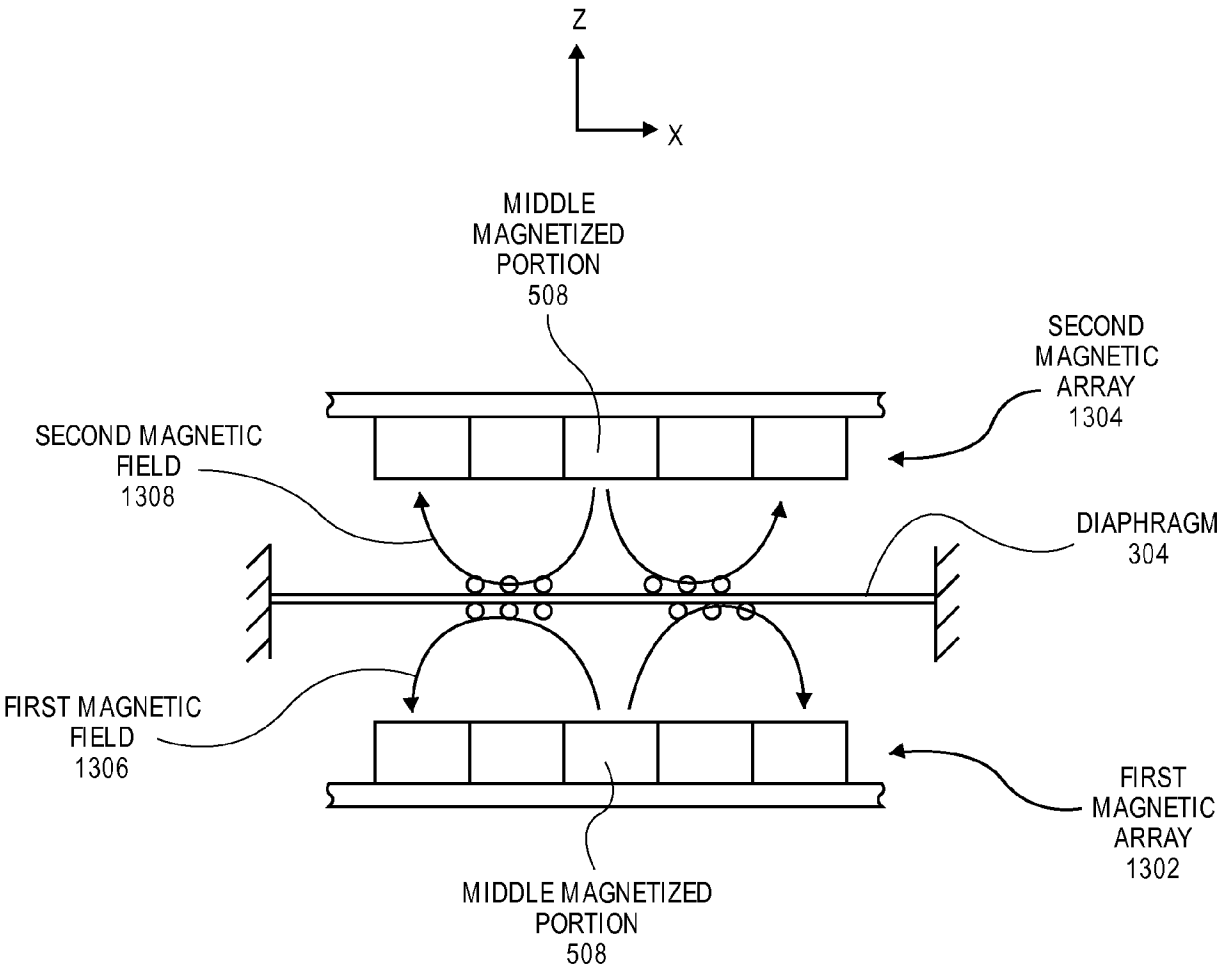
FIG. 13 is a sectional view of an audio speaker having a voicecoil running along a diaphragm surface within fringe fluxes of several magnetic arrays in accordance with an embodiment.

Referring to FIG. 13, a sectional view of an audio speaker having a voicecoil running along a diaphragm surface within fringe fluxes of several magnetic arrays is shown in accordance with an embodiment. In addition to increasing the density of conductive windings within a given volume, force acting on diaphragm during driving may also be increased by increasing the magnetic field applied to the given volume of conductive windings. In an embodiment, a first magnetic array 1302 may be located behind diaphragm, i.e., in a direction opposite to ports in device housing wall, and a second magnetic array 1304 may be located in front of diaphragm, i.e., in the same direction as ports from diaphragm. Thus, diaphragm and voicecoil attached to diaphragm may be sandwiched within respective magnetic fields generated by each magnetic array. For example, first magnetic array may include three or more magnetized portions arranged in a side-by-side manner, with middle magnetized portion directing a first magnetic field 1306 toward diaphragm, while second magnetic array may include three or more magnetized portions arranged in a side-by-side manner, with middle magnetized portion directing a second magnetic field 1308 toward diaphragm. In an embodiment, voicecoil may include a first conductive winding below diaphragm and a second conductive winding above diaphragm, but as described above, there may also be only one conductive winding or the conductive windings may be on a same side of diaphragm. First magnetic field may be directed from middle magnetized portion of first magnetic array toward a rear of diaphragm along central axis, which may run through a respective core area of each conductive winding in the voicecoil module. Similarly, second magnetic field may be directed from middle magnetized portion of second magnetic array toward a front of diaphragm along central axis. Thus, the conductive windings of voicecoil may be engulfed by respective fringe flux regions of first magnetic field and second magnetic field to drive diaphragm with more force than either magnetic field can produce alone, i.e., the two-layered magnetic array may make microspeaker approximately twice as efficient due to increased flux density through the windings relative to a single sided magnet array.

In any of the embodiments described above having multiple conductive windings stacked upon each other or located in different areas of dielectric surface, the windings may be actuated simultaneously, e.g., by electrically connecting the windings in series such that electrical current passes through a group of windings at once to actuate the diaphragm. In another embodiment, at least two conductive windings may be electrically independent, such that the windings may receive different electrical currents and therefore actuate diaphragm to different degrees. In an embodiment, conductive windings may be actuated separately, i.e., at least two conductive windings on diaphragm may be electrically connected to different current sources such that one conductive winding may be actuated separately from another conductive winding. As a result, one conductive winding may move diaphragm in response to a first electrical audio signal applied to the conductive winding and another conductive winding may move diaphragm in response to a second electrical audio signal applied to the another conductive winding. Thus, actuation of the diaphragm surface may be controlled precisely by controlling the electrical current delivered to each conductive winding. For example, more electrical current may be applied to a voicecoil module near a center of diaphragm as compared to electrical current applied to a voicecoil module near an edge of diaphragm, resulting in greater travel of diaphragm near the center than near the edge. By driving each conductive winding separately in this manner, an amplitude or phase of diaphragm may be controlled, which may have certain benefits. An example of a benefit is the control of smoothness of the higher frequency response by influencing of the modal behavior of the diaphragm, power handling improvements by preferentially driving the windings which have better heat-sinking capability due to greater surface area or proximity to an external heat sink, or influencing the directivity of the acoustic output to achieve a desirable audio dispersion pattern, such as a desired acoustic coverage pattern, or beam steering to preferentially direct the sound output. As already discussed, there is no requirement that the current distribution over the surface of the diaphragm be uniform—for example, it may be desirable to distribute the amp-turns preferentially toward the center of the diaphragm to increase the driving force in the central area. It may also be useful to adjust the conductor cross-sections within a given trace path such that certain portions of the diaphragm are endowed with a more massive trace in order to adjust the local mass distribution, for example. A similar effect may also be accomplished by varying the number of winding layers preferentially, for example, by locating a greater number of conductive layers closer to the center of the moving diaphragm, which would serve to increase local mass and driving force according to a design intent.

Figure 14:
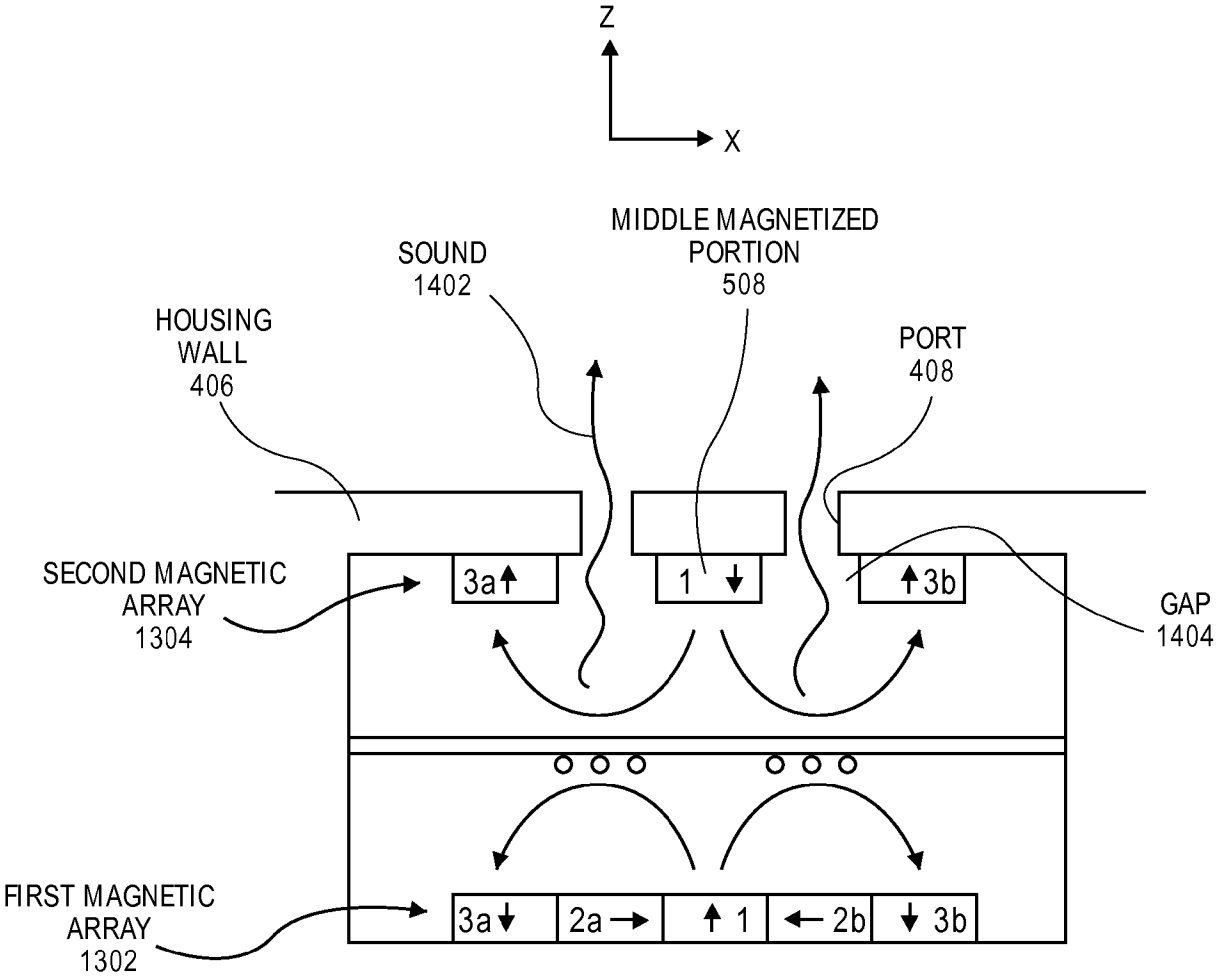
FIG. 14 is a sectional view of a front firing audio speaker having a voicecoil running along a diaphragm surface within fringe fluxes of several magnetic arrays in accordance with an embodiment.

Referring to FIG. 14, a sectional view of a front firing audio speaker having a voicecoil running along a diaphragm surface within fringe fluxes of several magnetic arrays is shown in accordance with an embodiment. Microspeaker may be a front-firing speaker that emanates sound in a direction of the Z axis. In an embodiment having a two-layered magnetic array with a first magnetic array and a second magnetic array, emission of a sound 1402 in a forward fashion may be facilitated by incorporating gaps 1404 between each magnetized portion in the second magnetic array such that a sound emitted from diaphragm in response to an electrical audio signal applied to voicecoil will travel forward through gaps 1404 and port 408 in housing wall into the surrounding environment. Gap may be between middle magnetized portion and an adjacent magnetized portion, for example. Alternatively, gap may be a hole formed through a portion of the adjacent magnetized portions. That is, second magnetic array may be a Halbach array in which the magnetized portions on either side of middle magnetized portion are intermittently broken up by gaps in the longitudinal direction. The intermittent breaks, i.e., gaps, may be holes formed through the magnetized portions to permit sound to propagate through port to the environment, or alternatively these gaps could be formed by starting with a five-magnet Halbach array with magnets 1, 2*a*, 2*b*, 3*a*, 3*b*, and eliminating magnets 2*a* and 2*b* altogether which has a relatively minor influence on the performance of the device. The embodiment of FIG. 14 could be extended by placing additional arrays side by side, merging the end magnets and making a continuous transducer of any X or Y extent desired.

In an embodiment, as shown in FIG. 14, a magnetic array may include a sequence of magnets separated from each other by gaps 1404 in which sequential magnets are oppositely poled, i.e., a first magnet is poled downward, the next magnet is poled upward, the next magnet is poled downward, and so on. Second magnetic array 1304 is arranged in such a manner as shown in FIG. 14. In embodiments, the sequentially arranged, oppositely poled magnetic array may be located behind the diaphragm. That is, in an embodiment, first magnetic array 1302 may have the magnet arrangement shown for second magnetic array 1304 in FIG. 14. Thus, the magnetic array arrangements described herein may be used in front of or behind a diaphragm of an audio speaker within the scope of this description.

Figure 15:
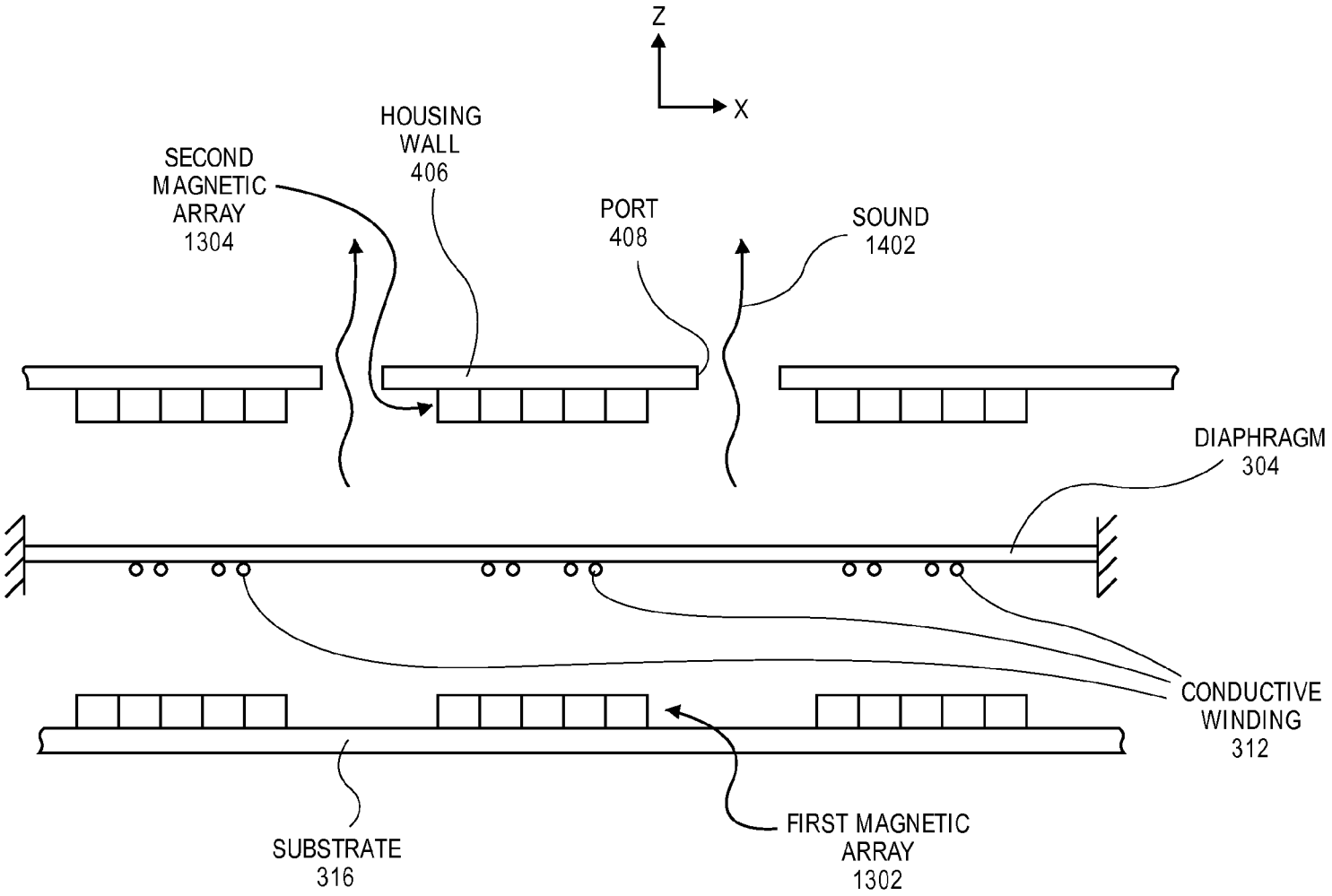
FIG. 15 is a sectional view of a front firing audio speaker having a voicecoil running along a diaphragm surface within fringe fluxes of several magnetic arrays in accordance with an embodiment.

Referring to FIG. 15, a sectional view of a front firing audio speaker having a voicecoil running along a diaphragm surface within fringe fluxes of several magnetic arrays is shown in accordance with an embodiment. In embodiment, another example of a front-firing microspeaker includes voicecoil modules having conductive windings paired with respective first magnetic arrays and second magnetic arrays, with each module separated in a transverse direction from one another. Such an embodiment is similar to the voicecoil modules described above with respect to FIG. 3, with the additional inclusion of second magnetic arrays attached to an upper substrate. The upper substrate may be housing wall, for example, which includes ports for sound to propagate through into the surrounding environment. Thus, voicecoil modules may be sequentially disposed along diaphragm with intermediate spaces to allow for sound emission through ports.

Figure 16:
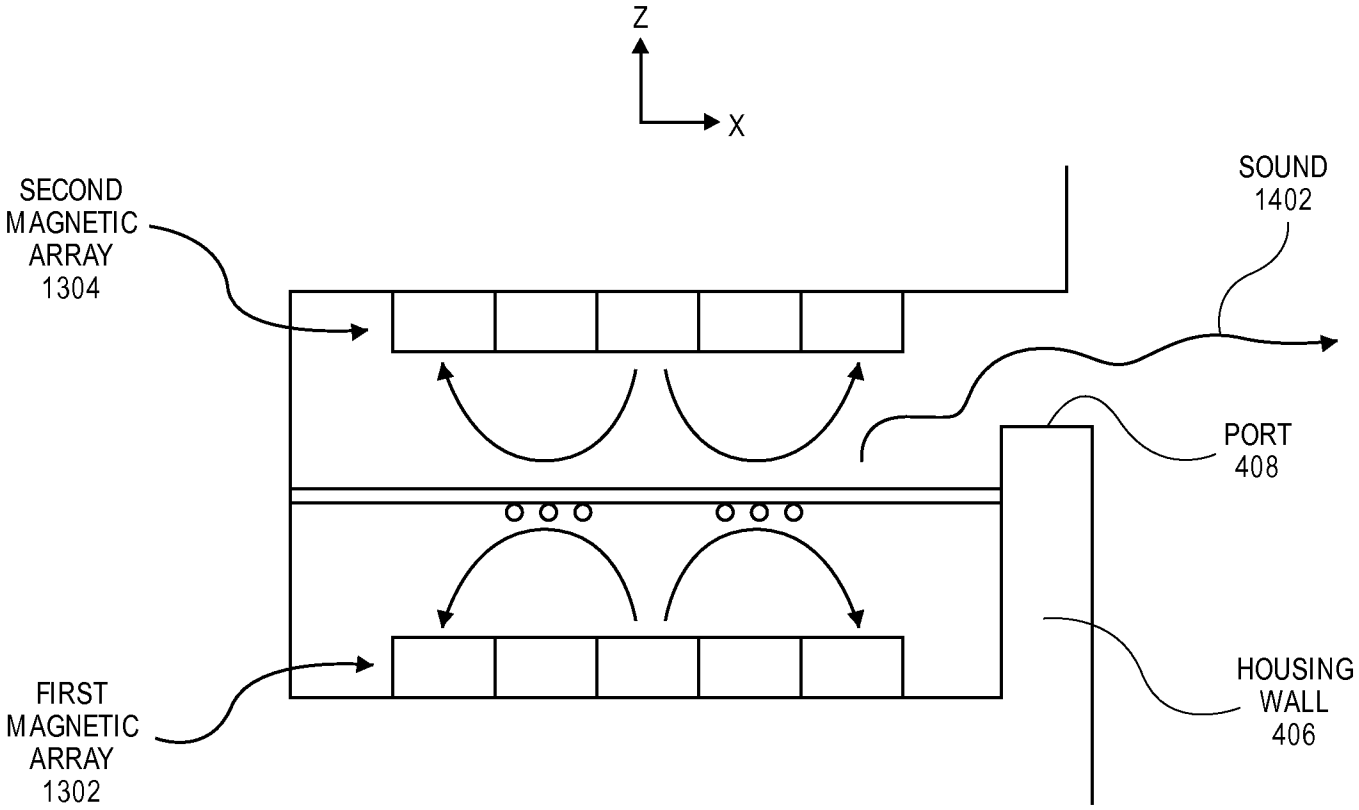
FIG. 16 is a sectional view of a side firing audio speaker having a voicecoil running along a diaphragm surface within fringe fluxes of several magnetic arrays in accordance with an embodiment.

Referring to FIG. 16, a sectional view of a side firing audio speaker having a voicecoil running along a diaphragm surface within fringe fluxes of several magnetic arrays is shown in accordance with an embodiment. Microspeaker may be a side-firing speaker. In an embodiment, a two-layered magnetic array with a first magnetic array and a second magnetic array, sound may be emitted forward toward second magnetic array and re-directed along a face of second magnetic array toward port in housing wall. Sound may thus be emitted through port into the surrounding environment.

Figure 17:
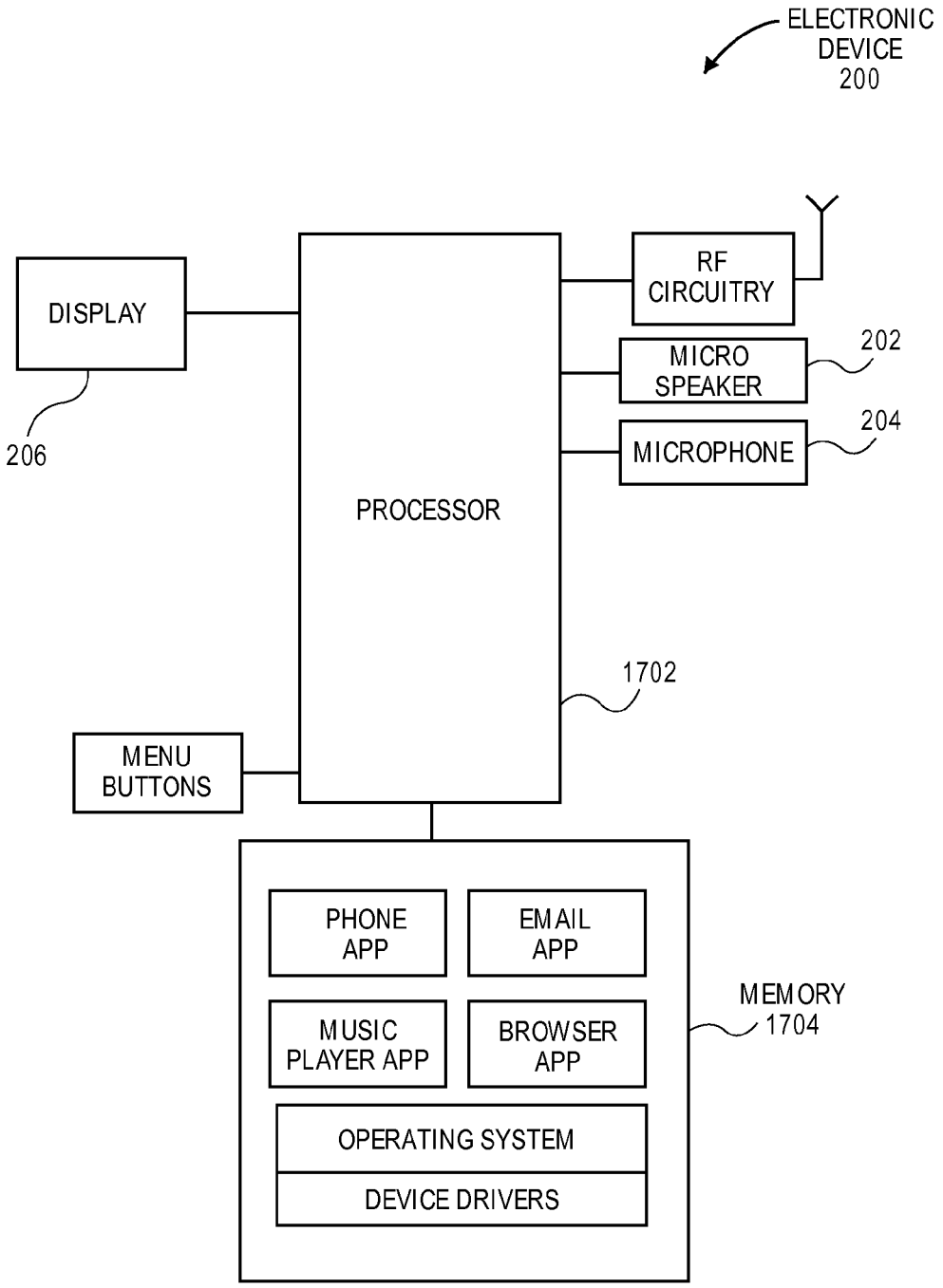
FIG. 17 is a block diagram of an electronic device having a microspeaker in accordance with an embodiment.

Referring to FIG. 17, a block diagram of an electronic device having a microspeaker is shown in accordance with an embodiment. As described above, electronic device 200 may be one of several types of portable or stationary devices or apparatuses with circuitry suited to specific functionality. For example, electronic device 200 may be a mobile phone handset, such as electronic device 200 shown in FIG. 2. Accordingly, electronic device may include a housing to contain or support various components, such as cellular network communications circuitry, e.g., RF circuitry, menu buttons, or display 206. The diagrammed circuitry of FIG. 17 is provided by way of example and not limitation. Electronic device may include one or more processors 1702 that execute instructions to carry out the different functions and capabilities described above. For example, processor may incorporate and/or communicate with electronics connected to micro speaker to provide electrical audio signals to drive voicecoil to generate sound. Instructions executed by the one or more processors of electronic device may be retrieved from a local memory 1704, and may be in the form of an operating system program having device drivers, as well as one or more application programs that run on top of the operating system, to perform the different functions introduced above, e.g., music play back. Audio output for music play back functions may be through an audio speaker, such as microspeaker.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An electromagnetic transducer for sound generation, comprising:

a diaphragm configured to move along a central axis, the diaphragm having a dielectric surface;

a voicecoil coupled with the dielectric surface, the voicecoil including a conductive winding having one or more conductive turns on the dielectric surface, wherein the one or more conductive turns run along the dielectric surface around the central axis; and a magnetic Halbach array including at least three magnetized portions arranged side-by-side, wherein each magnetized portion extends along a respective longitudinal axis and produces respective magnetic field lines perpendicular to the respective longitudinal axis, and wherein the magnetic Halbach array directs the magnetic field lines toward the voicecoil such that the magnetic field lines intersect the voicecoil to cause a Lorentz force to move the diaphragm along the central axis.

2. The electromagnetic transducer of claim 1, wherein the magnetic Halbach array includes five or more magnetized portions arranged side-by-side such that each magnetized portion that is sandwiched between two adjacent magnetic portions produces respective magnetic field lines perpendicular to respective magnetic field lines produced by the adjacent magnetic portions.

3. The electromagnetic transducer of claim 2, wherein the magnetized portions include magnetic rods, and wherein a middle magnetized portion of the magnetized portions includes a rod length along the respective longitudinal axis and a rod width.

4. The electromagnetic transducer of claim 3, wherein the magnetic field lines intersecting the voicecoil run parallel to the dielectric surface and perpendicular to the conductive winding.

5. The electromagnetic transducer of claim 4, wherein the one or more conductive turns of the conductive winding include a winding length and a winding width, wherein the winding length runs parallel to the longitudinal axis of the middle magnetized portion, and wherein the winding width is between 0.5 to 2.0 times the rod width.

6. The electromagnetic transducer of claim 5, wherein the one or more conductive turns of the conductive winding follow a spiral path along the dielectric surface.

7. The electromagnetic transducer of claim 6, wherein the spiral path is rectangular.

8. The electromagnetic transducer of claim 5, wherein the winding length is at least 2 times longer than the winding width.

9. The electromagnetic transducer of claim 8, wherein the conductive winding includes a winding thickness in a direction of the central axis, the winding thickness being less than 0.5 mm.

10. The electromagnetic transducer of claim 9, wherein the winding width is at least 20 times longer than the winding thickness.

11. The electromagnetic transducer of claim 5, wherein the one or more conductive turns are coplanar within a winding plane, the winding plane being perpendicular to the central axis, and wherein the one or more conductive turns surround a core area, the core area being centered over the middle magnetized portion.

12. The electromagnetic transducer of claim 11 further comprising one or more additional conductive windings coupled with the dielectric surface and one or more additional magnetic Halbach arrays having respective middle magnetized portions, wherein each additional conductive winding includes one or more conductive turns on the dielectric surface and around a respective core area, each respective core area centered over a respective middle magnetized portion of a respective magnetic Halbach array.

13. The electromagnetic transducer of claim 12, wherein the conductive winding and the one or more additional conductive windings are electrically connected in series such that the conductive winding and the one or more additional conductive windings simultaneously move the diaphragm in response to an electrical audio signal applied to the conductive winding.

14. The electromagnetic transducer of claim 12, wherein the conductive winding and the one or more additional conductive windings are not electrically connected such that the conductive winding moves the diaphragm in response to a first electrical audio signal applied to the conductive winding and the one or more additional conductive windings move the diaphragm in response to a second electrical audio signal applied to the one or more additional conductive windings.

15. An electromagnetic transducer for sound generation, comprising:

a diaphragm configured to move along a central axis, the diaphragm having a dielectric surface orthogonal to the central axis;

a voicecoil stack comprising a plurality of conductive windings coupled with the dielectric surface, each conductive winding within a respective coil layer, the respective coil layers separated along the central axis by one or more intermediate insulating layers, wherein the conductive windings are electrically connected in series; and a magnetic Halbach array including at least three magnetized portions arranged side-by-side, wherein each magnetized portion extends along a respective longitudinal axis and produces respective magnetic field lines perpendicular to the respective longitudinal axis, and wherein the magnetic Halbach array directs the magnetic field lines toward the voicecoil stack such that the magnetic field lines intersect the voicecoil to cause a Lorentz force to move the diaphragm along the central axis.

16. The electromagnetic transducer of claim 15, wherein the voicecoil stack includes a multiple of two coil layers.

17. An electromagnetic transducer for sound generation, comprising:

a diaphragm configured to move along a central axis, the diaphragm having a dielectric surface;

a voicecoil coupled with the dielectric surface, the voicecoil including a conductive winding having one or more conductive turns on the dielectric surface, wherein the one or more conductive turns run along the dielectric surface around the central axis;

a first magnetic Halbach array behind the diaphragm, the first magnetic Halbach array including at least three magnetized portions arranged side-by-side, wherein each magnetized portion extends along a respective longitudinal axis and produces respective magnetic field lines perpendicular to the respective longitudinal axis, and wherein the first magnetic Halbach array directs the respective magnetic field lines toward a rear of the diaphragm such that the magnetic field lines intersect the voicecoil to cause a Lorentz force to move the diaphragm along the central axis; and a second magnetic Halbach array in front of the diaphragm, the second magnetic Halbach array including at least three magnetized portions arranged side-by-side, wherein each magnetized portion extends along a respective longitudinal axis and produces respective magnetic field lines perpendicular to the respective longitudinal axis, and wherein the second magnetic Halbach array directs the respective magnetic field lines toward a front of the diaphragm such that the magnetic field lines intersect the voicecoil to cause the Lorentz force to move the diaphragm along the central axis.

18. The electromagnetic transducer of claim 17, wherein the second magnetic Halbach array includes a respective gap between each magnetized portion such that a sound emitted from the diaphragm in response to an electrical audio signal applied to the conductive winding travels forward through the gaps.

19. A mobile phone handset, comprising:

a housing;

a micro speaker coupled with the housing, the micro speaker comprising:

a diaphragm configured to move along a central axis, the diaphragm having a dielectric surface, a voicecoil coupled with the dielectric surface, the voicecoil including a conductive winding having one or more conductive turns on the dielectric surface wherein the one or more conductive turns run along the dielectric surface around the central axis, and a magnetic Halbach array including at least three magnetized portions arranged side-by-side, wherein each magnetized portion extends along a respective longitudinal axis and produces respective magnetic field lines perpendicular to the respective longitudinal axis, and wherein the magnetic Halbach array directs the magnetic field lines toward the voicecoil such that the magnetic field lines intersect the voicecoil to cause a Lorentz force to move the diaphragm along the central axis; and a processor to provide an electrical audio signal to the conductive winding, wherein the conductive winding moves the diaphragm in response to the electrical audio signal.

20. The mobile phone handset of claim 19, wherein the magnetic Halbach array includes five or more magnetized portions arranged side-by-side such that each magnetized portion that is sandwiched between two adjacent magnetic portions produces respective magnetic field lines perpendicular to respective magnetic field lines produced by the adjacent magnetic portions.

21. The mobile phone handset of claim 20, wherein the magnetized portions include magnetic rods, and wherein a middle magnetized portion of the magnetized portions includes a rod length along the respective longitudinal axis and a rod width.

22. The mobile phone handset of claim 21, wherein the magnetic field lines intersecting the voicecoil run parallel to the dielectric surface and perpendicular to the conductive winding.

23. An electromagnetic transducer for sound generation, comprising:

a diaphragm configured to move in a vertical direction, the diaphragm having a dielectric surface;

a plurality of conductive windings coupled to the diaphragm and separated from each other in a transverse direction, wherein each conductive winding of the plurality of conductive windings has one or more conductive turns on the dielectric surface; and a plurality of magnetic Halbach arrays each having at least three magnetized portions arranged side-by-side, wherein the plurality of conductive windings are paired with the plurality of magnetic Halbach arrays such that each magnetic Halbach array is solely under a respective conductive winding of the plurality of conductive windings.

* * * * *